US006311039B1

(12) United States Patent
Funamizu et al.

(10) Patent No.: US 6,311,039 B1
(45) **Date of Patent: *Oct. 30, 2001**

(54) SHEET CONVEYING APPARATUS AND IMAGE FORMING APPARATUS PROVIDED WITH THE SAME

(75) Inventors: Yoshihiro Funamizu; Kazuhiko Hirooka; Tatsuhito Kataoka, all of Numazu; Katsumi Takahashi, Shizuoka-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/425,732

(22) Filed: Oct. 22, 1999

(30) Foreign Application Priority Data

Oct. 26, 1998 (JP) ..... 10-304431
Oct. 30, 1998 (JP) ..... 10-310352
Nov. 4, 1998 (JP) ..... 10-312890

(51) Int. Cl.[7] ..... G03G 15/00
(52) U.S. Cl. ..... 399/394; 399/16
(58) Field of Search ..... 399/16, 21, 23, 399/388, 394, 396, 18, 19

(56) References Cited

U.S. PATENT DOCUMENTS 4,589,765 * 5/1986 Perun et al. ..... 399/21
4,669,853 * 6/1987 Sosinski et al. ..... 399/11
4,708,456 * 11/1987 Shibata et al. ..... 399/394
4,796,035 * 1/1989 Kawasaki et al. ..... 346/108
4,804,998 * 2/1989 Miyawaki ..... 399/21
4,878,428 * 11/1989 Watarai ..... 101/489
5,290,024 * 3/1994 Takahashi ..... 271/122
5,440,382 * 8/1995 Suga ..... 399/394
5,474,287 * 12/1995 Takahashi ..... 271/10.13
5,485,247 1/1996 Morishita et al. .
5,543,909 * 8/1996 Quesnel ..... 399/394
5,909,872 * 6/1999 Takahashi ..... 271/116

FOREIGN PATENT DOCUMENTS 57-107350 7/1982 (JP) .
59-022833 * 2/1984 (JP) .
1-236131 9/1989 (JP) .
3-223033 * 10/1991 (JP) .

* cited by examiner

*Primary Examiner*—Robert Beatty
(74) *Attorney, Agent, or Firm*—Fitzpatrick, Cella, Harper & Scinto

(57) ABSTRACT

A sheet conveying apparatus is provided with a sheet feeding device for feeding sheets from a sheet supporting device on which the sheets are supported, a first sheet conveying device, a second sheet conveying device and a third sheet conveying device successively disposed downstream of the sheet supporting device with respect to the feeding direction of the sheets for conveying the sheets, a sheet interval judging device for detecting the passage of the sheets between the second sheet conveying device and the third sheet conveying device, and judging whether the interval between the sheets is a predetermined interval, and control device for controlling the sheet feeding device, the first sheet conveying device and the second sheet conveying device so that the sheets can be conveyed at the predetermined interval on the basis of the judgement of the sheet interval judging device.

34 Claims, 13 Drawing Sheets

SHEET CONVEYING APPARATUS AND IMAGE FORMING APPARATUS PROVIDED WITH THE SAME

BACKGROUND OF THE INVENTION

1. Field of the Invention

This invention relates to an image forming apparatus such as an electrophotographic type analog copying machine, a digital copying machine, a color copying machine, a printer or a page printer.

2. Related Background Art

The speedup of the image forming speed in an electrophotographic type image forming apparatus has heretofore been carried out by effecting, in addition to the supply and conveyance of a transfer material, all of a series of operations such as image forming processes, i.e., latent image formation, development, the transfer of a toner image to the transfer material (e.g. a transfer sheet or the like) and further, fixing, at a high speed. For example, to realize an apparatus capable of forming 60 sheets of images per minute, relative to an apparatus capable of forming 30 sheets of images per minute, there has been adopted a construction in which in addition to the supply and conveyance of the transfer material, image forming processes are carried out with a driving speed necessary therefor set to double.

In the above-described example of the prior art, however, in order to realize high-speed image formation, with the speedup of the sheet supply speed of transfer material supplying means for successively drawing out transfer materials supported on transfer material supporting means (e.g. a sheet supply cassette or the like), it has been necessary to provide inter-sheet taking into account a reduction in the accuracy of the interval between transfer materials during the continuous supply of the transfer materials, i.e., the inter-sheet interval (hereinafter referred to as the inter-sheet). Also, in addition to the conveyance of the transfer materials, it has been required to speedup the image forming processes and a large-scaled investigation has been required.

Thus, for example, in the latent image formation in the image forming processes, in a digital image forming apparatus, it is necessary to operate the image processing and latent image forming means thereof such as a laser at a high speed, and for example, when development is to be made from an apparatus capable of forming 30 sheets of images per minute to an apparatus capable of forming 60 sheets of images per minute, an image processing portion or the like of which the image clock frequency is doubled has been required. Also, in an analog image forming apparatus, it has been necessary to double the driving speed of an original scanner for scanning (reading-scanning) an original to be copied.

Further, in both of the digital and analog image forming apparatuses, the image forming processes such as the development and transfer of a toner image are the most important techniques, as it were, in an electrophotographic type image forming apparatus, and a long investigation time has been required before the construction and control technique thereof are determined, and there has been a problem to be solved that considerable resources are required for the development of an image forming apparatus resulting from high-speed image formation.

SUMMARY OF THE INVENTION

It is an object of the present invention to provide an image forming apparatus in which the accuracy of sheet conveyance is improved and which is capable of effecting small inter-sheet control and high in reliability to thereby easily realize the speedup of the image forming speed without changing the speed of the image forming processes.

It is a further object to provide a sheet conveying apparatus which, when the interval between sheets has become shorter, can make the interval into a normal interval, and an image forming apparatus which is provided with the same and which makes the interval between sheets sent to an image forming part substantially constant and which is high in image forming efficiency as well as in productivity.

The image forming apparatus of the present invention is characterized by sheet feeding means for successively feeding sheets supported on sheet supporting means, first registration correcting means for taking the registration of the sheets fed from the sheet supporting means, second registration correcting means for taking the registration of the sheets between the first registration correcting means and an image recording position, sheet interval detecting means for detecting the interval between the sheets provided between the first registration correcting means and the second registration correcting means, judging means for judging whether the interval between the sheets detected by the sheet interval detecting means is a predetermined interval, and control means for controlling the sheet feeding means and the first registration correcting means independently of each other in conformity with the result of the judgement of the judging means.

Preferably, the sheet interval detecting means has a judgement sensor provided between the first registration correcting means and the second registration correcting means for detecting the sheets, and a judgement timer starting time counting in conformity with the detection by the judgement sensor, and the judgement reference of the judging means is a plurality of predetermined values compared with the counted value of the judgement timer.

Also, preferably, the judging means judges delay for a sheet of arrival timing exceeding a first judgement reference, judges delayed jam for a sheet of arrival timing exceeding a second judgement reference, judges early arrival for a sheet of arrival timing not exceeding a third judgement reference, and judges early arrival jam for a sheet of arrival timing not exceeding a fourth judgement reference, and in conformity with the results of the respective judgements, the control means controls the sheet feeding means and the first registration correcting means independently of each other.

The sheet conveying apparatus of the present invention is provided with sheet feeding means for feeding sheets from sheet supporting means on which the sheets are supported, first sheet conveying means, second sheet conveying means and third sheet conveying means successively disposed downstream of the sheet supporting means with respect to the feeding direction of the sheets for conveying the sheets, sheet interval judging means for detecting the passage of the sheets between the second sheet conveying means and the third sheet conveying means, and judging whether the interval between the sheets is a predetermined interval, and control means for controlling at least the first sheet conveying means and the second sheet conveying means of the sheet feeding means, the first sheet conveying means and the second sheet conveying means so that the sheets can be conveyed at a predetermined interval on the basis of the judgement of the sheet interval judging means.

The above-described sheet conveying apparatus of the present invention is adapted to feed sheets from the sheet supporting means by the sheet feeding means, and convey the sheets by the first, second and third sheet conveying means.

At this time, the sheet interval judging means detects the interval between the sheets, and judges whether the interval is a predetermined interval, and on the basis of this judgement, the control means controls at least the first and second sheet conveying means so that the sheets can be conveyed at the predetermined interval when the interval between the sheets is shortened.

DETAILED DESCRIPTION OF THE PREFERRED EMBODIMENTS

Some embodiments of the present invention will hereinafter be described in detail with reference to the drawings.

(First Embodiment)

[General Construction of the Apparatus]

Figure 1:
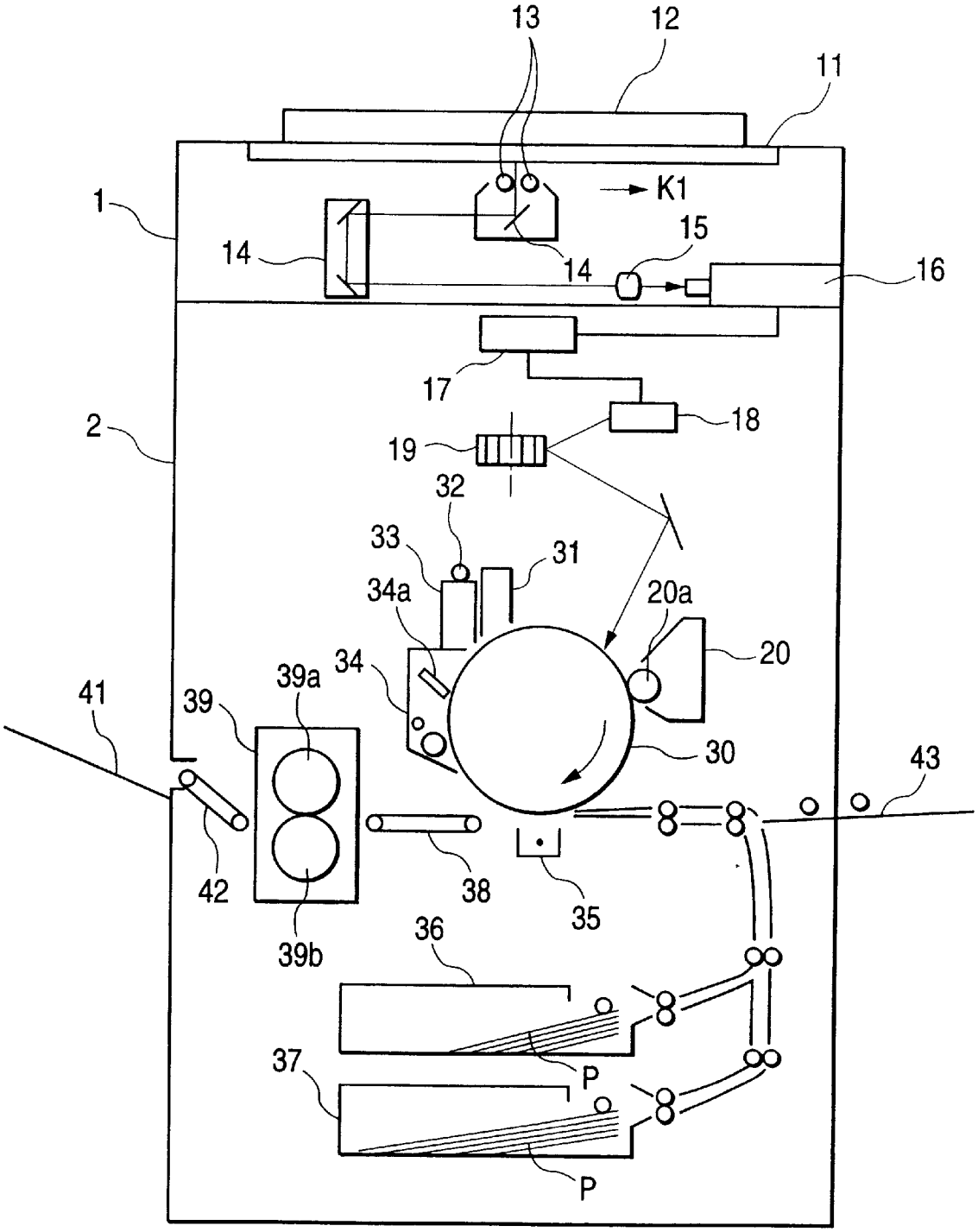
FIG. 1 is a vertical cross-sectional view schematically showing the construction of an image forming apparatus according to an embodiment of the present invention.

FIG. 1 schematically shows the construction of an electrophotographic type digital image forming apparatus as an example of an image forming apparatus suitable for applying the present invention thereto. The construction and operation of the apparatus will first be described with reference to FIG. 1. The image forming apparatus of FIG. 1 is provided with a reader portion 1 in the upper portion thereof, and a printer portion 2 in the lower portion thereof.

The reader portion 1 is comprised chiefly of an original supporting table 11 on which an original is placed, an original pressing plate 12 for pressing the original placed from above it, a light source 13 for irradiating the image bearing surface of the original, a plurality of mirrors 14 and a lens 15 for directing reflected light from the image bearing surface of the original, and a photoelectric converting part 16 having the function of photoelectrically converting the reflected light by a solid state image pickup element (not shown) such as a CCD (charge coupled device), and effecting various kinds of image processing on the obtained electrical signal. Further, the image processing part 16 has image processing functions such as photoelectric conversion, A/D (analog-digital) conversion, S/H (sample and hold), shading correction, masking correction, focal length change and LOG conversion (logarithmic conversion).

The operation of the reader portion 1 constructed as described above is as follows. An original is placed on the original supporting table 11 in such a manner that the image bearing surface thereof faces downwardly, and the original is pressed down from above it by the original pressing plate 12. The light source 13 is moved in the direction of arrow K1 while applying light to the original, and scans the image bearing surface of the original. The reflected light image from the image bearing surface of the original is formed on the CCD through the intermediary of the plurality of mirrors 14 and the lens 15, and is photoelectrically converted into an electrical signal there. This image signal which has become an electrical signal is subjected to various kinds of image processing in the image processing part 16, and is delivered to the printer portion 2 at the next stage.

The printer portion 2, as shown in FIG. 1, is comprised chiefly of a laser element 18, an image control part 17 for converting the electrical signal delivered from the reader portion 1 into a signal for driving the laser element 18, a polygon scanner 19 for scanning the surface of a photosensitive drum which will be described later by a laser beam, an image forming part including the photosensitive drum, and a fixing unit 39 disposed at the most downstream side.

Also, the above-mentioned image forming part is provided with a photosensitive drum 30 supported for rotation in the direction of arrow, a primary charger 31 for uniformly charging the surface of the photosensitive drum 30, a developing device 20 for developing an electrostatic latent image on the photosensitive drum 30, a transfer charger 35 for transferring a toner image on the photosensitive drum 30 to a transfer material P, a cleaner 34 for removing any untransferred toner on the photosensitive drum 30, a cleaner blade 34*a* in the cleaner 34 for scraping off the residual toner on the photosensitive drum 30, an auxiliary charger 33 for effecting the removal of charges, and a pre-exposure lamp 32 for removing any residual charges, these being disposed around the photosensitive drum 30 substantially in the named order along the direction of rotation thereof.

Further, a developing roller 20*a* is disposed in the developing device 20, and the developing roller 20*a* is rotated in a direction opposite to the direction of rotation of the photosensitive drum 30, whereby the toner image may be developed on the photosensitive drum 30.

The transfer material P to which the toner image has been transferred in this manner is conveyed to the fixing unit 39 by a pre-fixing conveying belt 38, and there fixing rollers 39*a* and 39*b* are rotated to convey the transfer material P, whereby the transfer material P is pressed by the fixing rollers 39*a* and 39*b* and is heated thereby, whereby the toner image on the surface of the transfer material P is fixed. After the fixing, the transfer material P is finally discharged to a sheet discharge tray 41 outside the main body of the apparatus by a conveying belt 42.

The supply conveying part for effecting the supply and conveyance of the transfer material P has a conveying path for the transfer material P, and is provided with a sheet feeding device at the most upstream side with respect to the direction of conveyance of the transfer material P, the sheet feeding device having an upper sheet supply cassette (upper stage sheet supply cassette) 36, a lower sheet supply cassette (lower stage sheet supply cassette) 37, a sheet supplying roller, conveying rollers, etc. Besides this sheet feeding device, there is provided a multi-sheet feeding device 43. From this multi-sheet feeding device 43, various transfer materials P differing in quality, size, etc. can be supplied to the image forming part because the sheet feeding path thereof is substantially straight.

[Control System]

Figure 2:
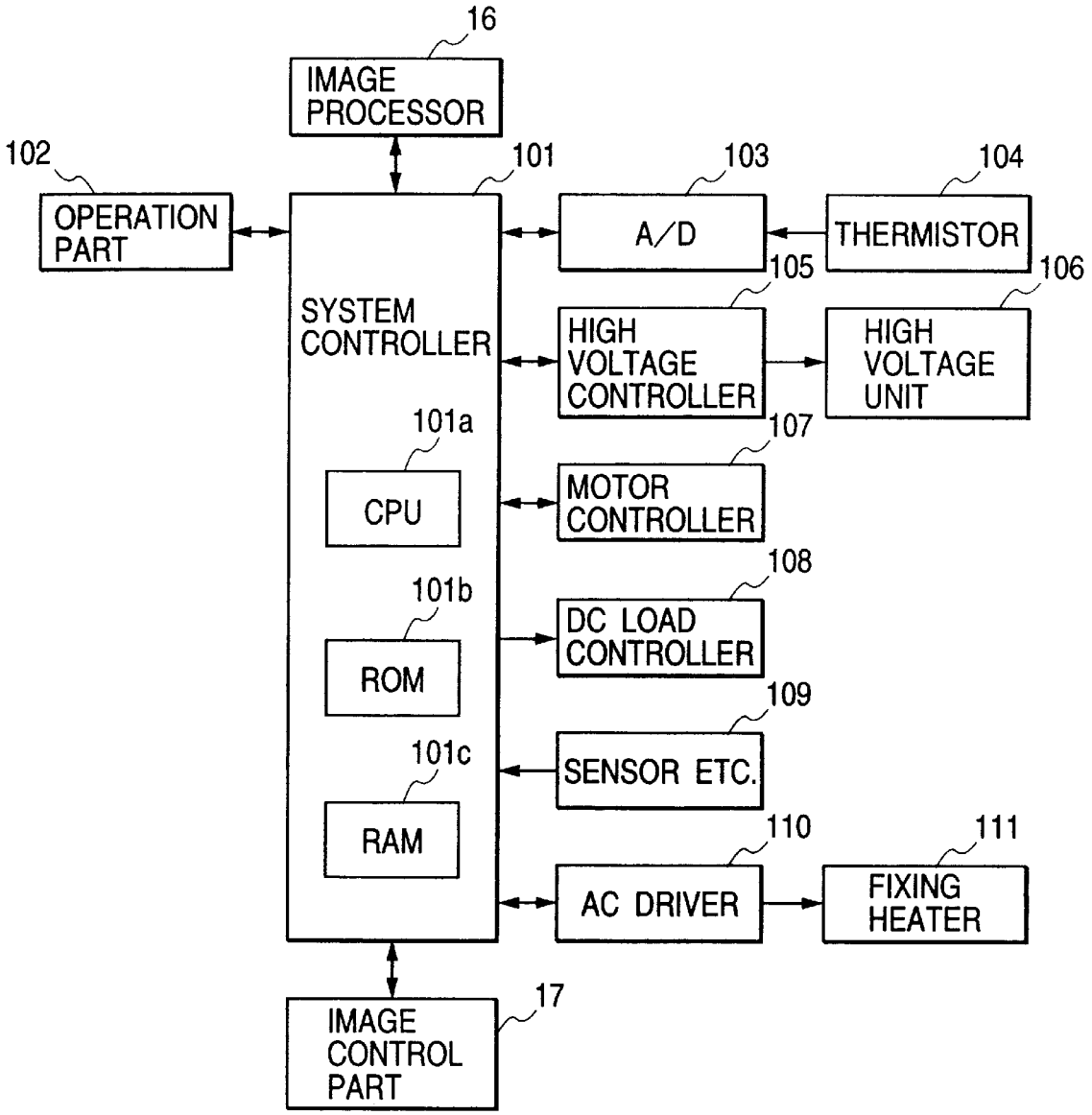
FIG. 2 is a block diagram showing an example of the construction of the control system of the image forming apparatus according to an embodiment of the present invention.

The construction of the control system of the above-described image forming apparatus is shown in FIG. 2. This apparatus is generally controlled by a system controller 101. The system controller 101 bears chiefly the roles of the driving of each load in the apparatus, the collection and analysis of the information of sensors, and the exchange of data with an operation part 102, i.e., a user interface, in addition to the aforedescribed image processing part 16 and image control part 17.

The internal construction of the system controller 101 is such that a CPU (central processing control unit) 101*a* is carried thereon in order to bear the above-described roles, and the CPU 101*a* executes various sequences concerned with a predetermined image forming sequence by a program stored in a ROM (read only memory) 101*b* likewise carried on the system controller 101. A RAM (random access memory) 101*c* is also carried on the system controller 101 in order to store therein reuritable data which need be temporarily or permanently preserved at that time. A high voltage set value, for example, to a high voltage controller 105 which will be described later, various data which will be described later, image forming command information from the operation part 102, etc. are preserved in the RAM 101*c*.

Description will now be made of the data exchange with the image processing part 16, the image control part 17 and the operation part 102 which is the first role of the system controller 101. The image processing part 16, as previously described, carries out various kinds of image processing such as the A/D conversion of the image signal from the CCD (not shown), S/H, shading correction, masking correction, focal length change and LOG conversion. The system controller 101, in addition to delivering the specification set value data of each part necessary for the image processing, receives a signal from each part, e.g. an original image density signal or the like, and controls the high voltage controller 105 which will be described later and the image control part 17 and effects the setting for effecting optimum image formation.

The image control part 17 optimally controls the laser element 18 of FIG. 1 on the basis of the prescription of the image size for forming an image and digital video data image-processed by the image processing part 16. That is, the image control part 17 effects the setting necessary to PWM (pulse width modulation)-process a laser beam emitted from the laser element 18.

The operation part (referred to also as the operation panel) 102 includes a ten-key for a user to set instructions to the present apparatus, a touch panel display, a start key, a stop key, a reset key, a pre-heating key, a pilot lamp, etc. The system controller 101, in addition to obtaining information such as a copying magnification and a density set value set by the user through the operation part 102, delivers to the operation part 102 the information regarding the state of the image forming apparatus, e.g. the number of image forming sheets and whether the apparatus is forming an image, and data for indicating the occurrence of jam and the place of occurrence of the jam to the user.

Description will now be made of the driving of each load in the apparatus and the collection and analysis of the information of sensors which are the second role of the system controller 101. The present image forming apparatus has DC loads such as motors and a clutch/solenoid and sensors such as a photointerrupter and microswitches disposed at various locations therein. That is, the motor and each DC load are suitably driven to thereby effect the conveyance of the transfer material and the driving of each unit, and various sensors 109 monitor that operation.

So, the system controller 101 controls each motor by a motor controller 107 on the basis of signals from the various sensors 109 and at the same time, operates the clutch/solenoid by a DC load controller 108 to thereby smoothly put forward the image forming operation. Also, the system controller 101 delivers various high voltage control signals to the high voltage controller 105 to thereby apply appropriate high voltages to the primary charger 31, the auxiliary charger 33, the transfer charger 35 and the developing roller 20*a* which are chargers constituting a high voltage unit 106.

Further, each of the fixing rollers 39*a* and 39*b* in the aforedescribed fixing device 39 contains therein a heater 111 for heating the roller, and each heater is ON/OFF-controlled by an AC driver 110. Also, a thermistor 104 for measuring the temperature of each of the fixing rollers 39*a* and 39*b* is provided in each fixing roller, and a change in the resistance values of the thermistors 104 conforming to a change in the temperature of the fixing rollers 39*a* and 39*b* is converted into a voltage value, whereafter this voltage value is converted into a digital value by an A/D converter 103, and this digital value is inputted as temperature data to the system controller 101. The system controller 101 controls the AC driver 110 on the basis of this temperature data.

[Sheet Supply Conveying Portion]

Figure 3:
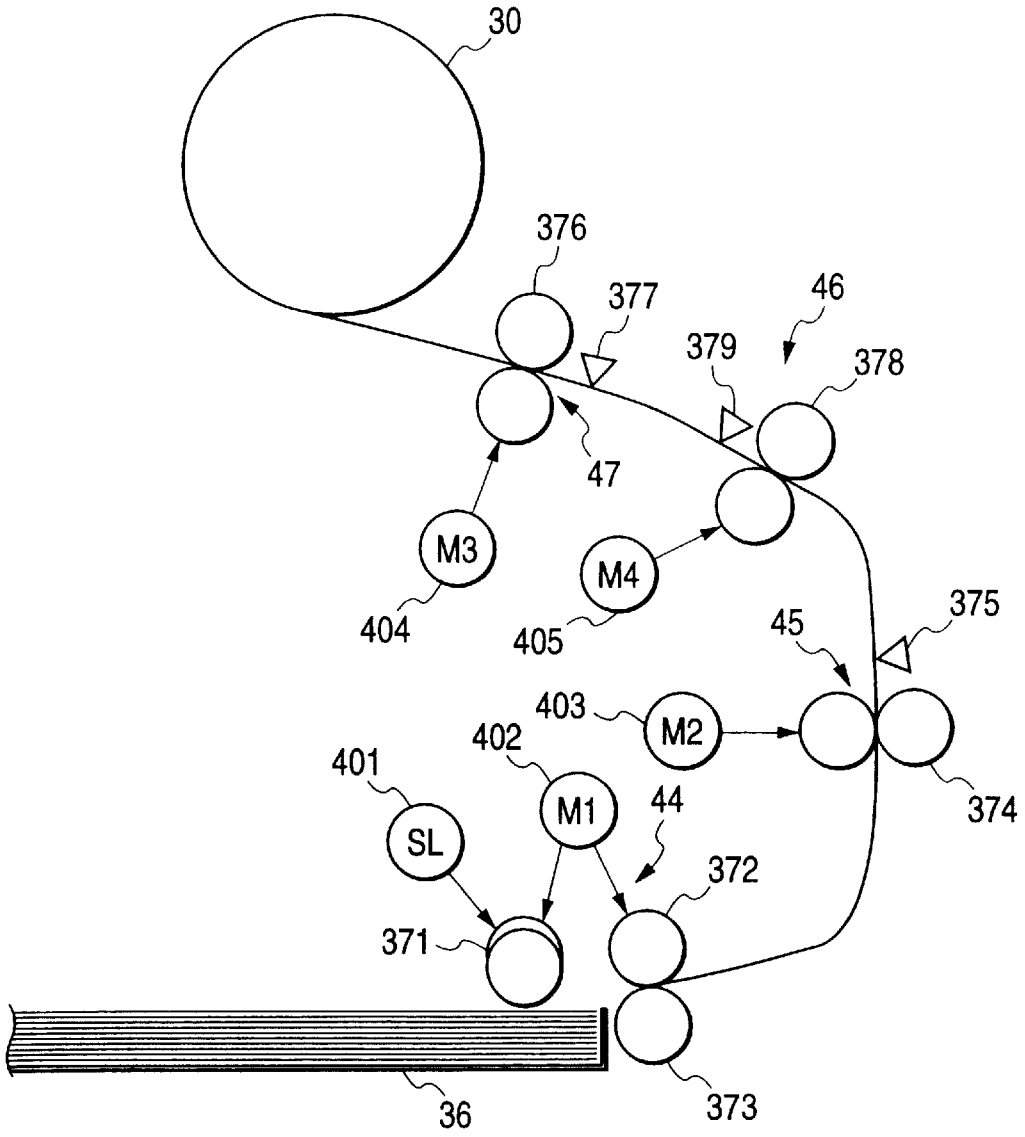
FIG. 3 is a typical view showing the construction of a sheet supply conveying portion for supplying and conveying the transfer material of the image forming apparatus of FIG. 1 according to the present invention to the transfer position of a photosensitive drum.

A sheet supply conveying portion for supplying the transfer material to the transfer position of the photosensitive drum 30 and conveying it will hereinafter be described with reference to FIG. 3. This sheet supply conveying portion is comprised of a sheet supplying part 44, a pre-registration correcting part 45, an inter-sheet judging part 46 and a main registration correcting part 47.

The sheet supplying part 44 is comprised of an A roller 371 for picking up transfer materials one by one from the cassette 36 containing the transfer materials therein, and a B roller 372 and a C roller 373 for separating the picked-up transfer materials one by one. The pre-registration correcting part 45 is comprised of pre-registration rollers 374 for taking the registration of the transfer material separated by the B and C rollers 372 and 373, and a pre-registration sensor 375 used for the control of the pre-registration rollers 374.

The inter-sheet judging part 46 is comprised of a judgement sensor 379 for detecting the interval between transfer materials when the transfer materials are continuously supplied. The main registration correcting part 47 is comprised of registration rollers 376 for taking the registration of the transfer material when the image developed on the surface of the photosensitive drum 30 is transferred to the transfer material, and a registration sensor 377 used for the control of the registration rollers 376.

Also, in the present embodiment, a first drive source for driving the A, B and C rollers 371 to 373 of the sheet supplying part, a second drive source for driving the pre-registration rollers 374 of the pre-registration correcting part and a third drive source for driving the registration rollers 376 of the main registration correcting part are constituted by independent drive sources, and in the present embodiment, they are driven by a first DC motor (M1) 402, a second DC motor (M2) 403 and a third DC motor (M3) 403, respectively.

The sheet supplying part will now be described in greater detail with reference to FIG. 4. The sheet supplying part is comprised of a sheet supply pickup part and a separating and conveying part. The sheet supplying part supplies the transfer materials by the A roller 371 for picking up the transfer materials one by one from the cassette 36 containing the transfer materials therein. Also, this A roller 371 is moved up and down in conformity with predetermined sheet supply interval timing to thereby pick up the transfer material. In the present embodiment, the A roller 371 is moved up and down by a solenoid (SL) 401.

Description will now be made of a separating mechanism part for separating the picked-up transfer materials one by one. This separating mechanism part is such that the B roller 372 and the C roller 373 opposed to each other in FIG. 4 are rotated counter-clockwisely as viewed in FIG. 4 to thereby convey the transfer material picked up by the A roller 371. Also, when a plurality of transfer materials are picked up by the A roller 371, the C roller 373 is rotated reversely (clockwisely), whereby the first (uppermost) transfer material and subsequent (underlying) transfer materials are stuck and separated by the B roller 372.

When the sheet supply is effected by the A roller 371, depending on the behavior of the first (uppermost) transfer material and subsequent (underlying) transfer materials, irregularity occurs to the amount of overrun by which the transfer material passes over the B and C rollers 372 and 373, for the ON timing of the driving of the A roller 371. This irregularity is corrected by the above-described pre-registration correcting part.

Figure 4:
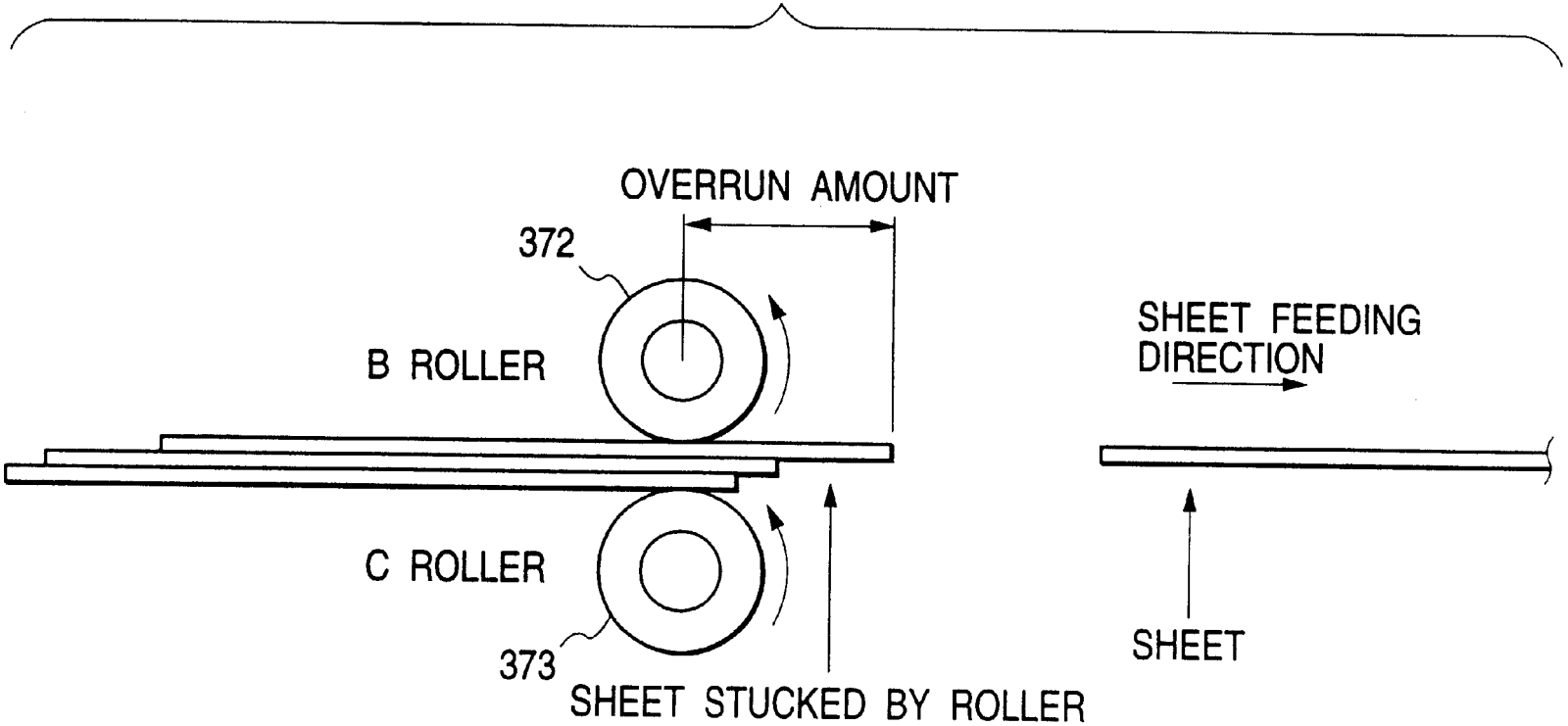
FIG. 4 is a typical view showing the construction of the sheet supply conveying portion of the image forming apparatus of FIG. 1 according to the present invention.

Also, in the present embodiment, in order to suppress the irregularity of the amount of overrun, the above-mentioned first drive source is slowed up to thereby effect more stable sheet supply in which the irregularity of the amount of overrun shown in FIG. 4 is little.

[Judgement Flow]

Figure 5:
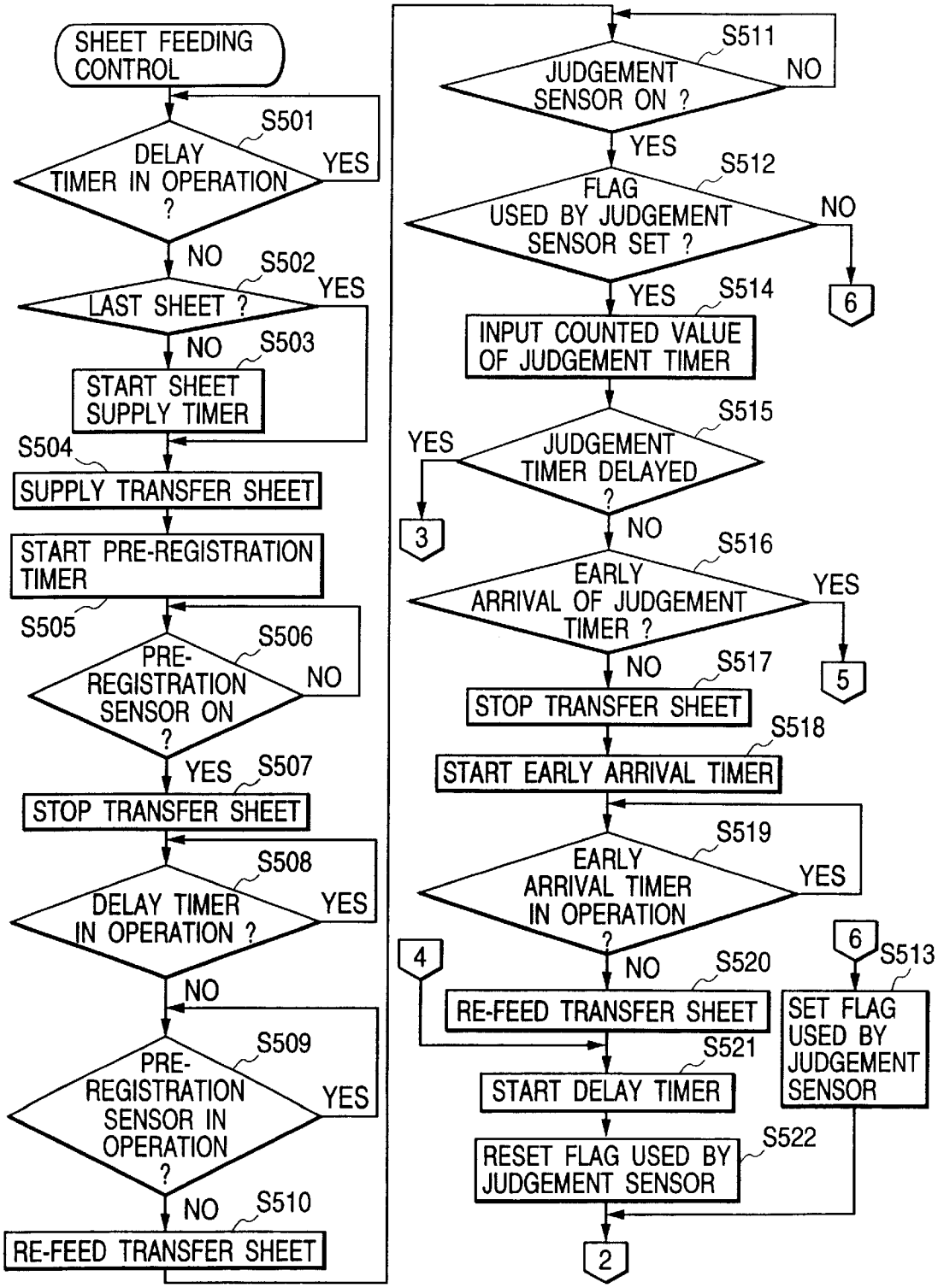
FIG. 5 is a flow chart showing the control procedure of the controller 101 of an image forming apparatus according to a first embodiment of the present invention.
Figure 6:
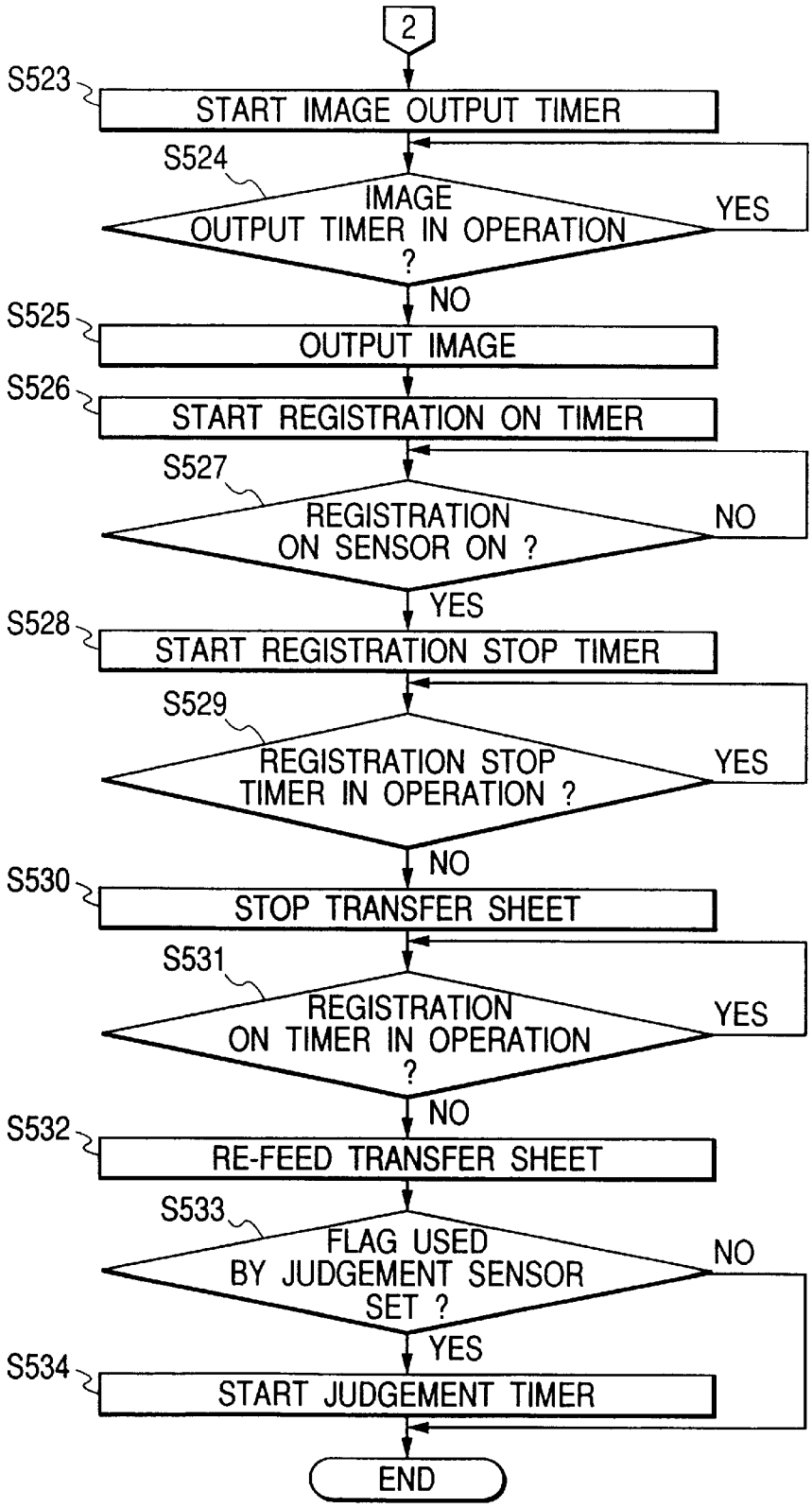
FIG. 6 is a flow chart showing a control procedure continued from the flow of FIG. 5.
Figure 7:
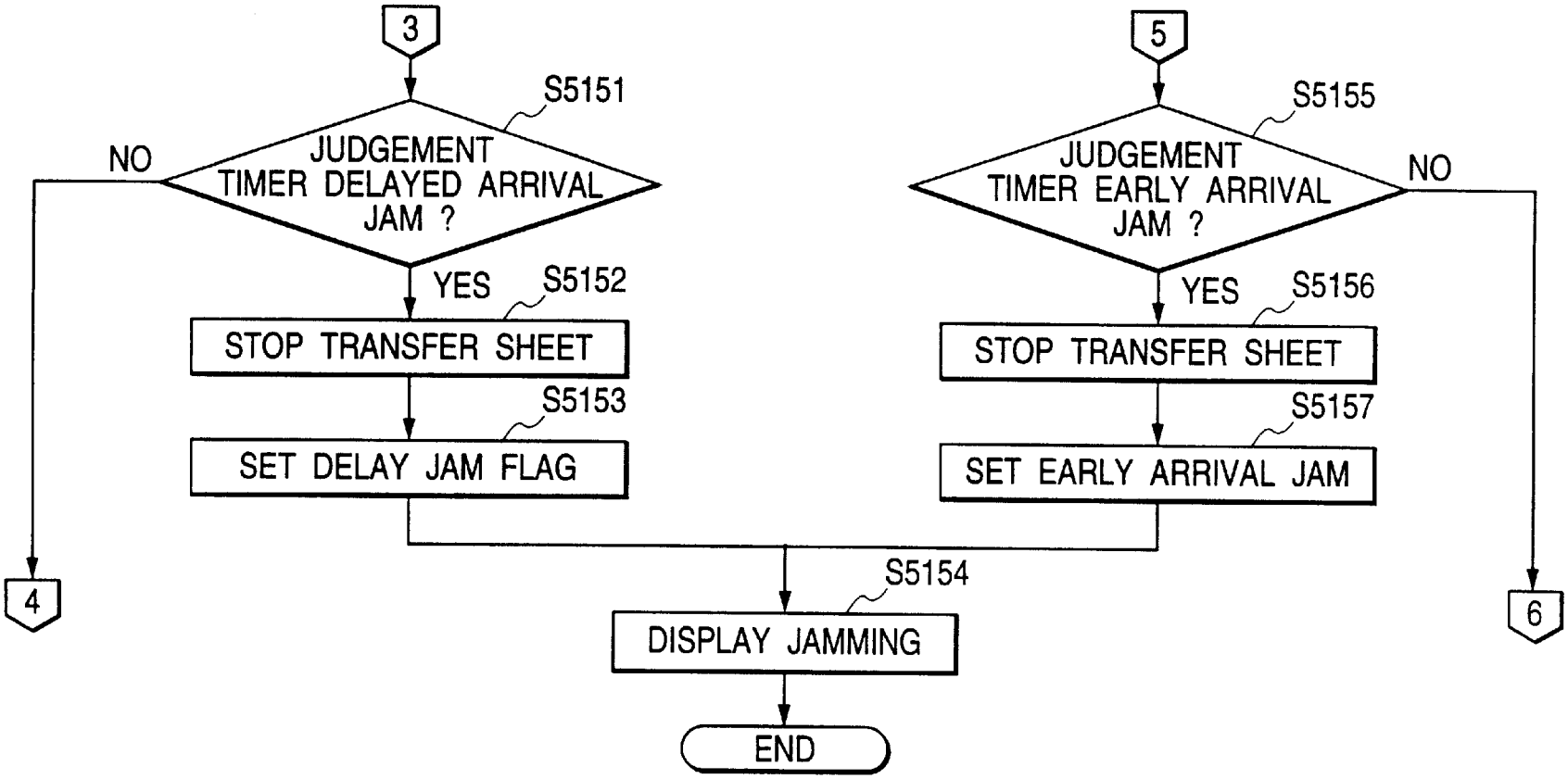
FIG. 7 is a flow chart showing a control procedure continued from the flow of FIG. 6.

FIGS. 5, 6 and 7 are flow charts showing the control procedure of the controller 101 of the image forming apparatus according to the present invention, and show an example of the sheet feeding control of the transfer material.

It is to be understood that first to fourth reference values within a predetermined range compared with the counted value of a judgement timer which will hereinafter be described are in the following magnitude relation:

fourth reference value<third reference value<first reference value<second reference value First, when the sheet feeding control is started, if at a step S501, a delay timer (set in the system controller 101) which will be described later is in operation, the termination of the operation is waited for.

Next, at a step S502, whether the transfer sheet which is about to be fed is the last sheet is judged, and if it is not the last sheet, at a step S503, a sheet supply timer (set in the system controller 101) for obtaining the timing for the sheet feeding control of the next transfer sheet is started, and at a step S504, the A roller 371 is operated to supply the transfer sheet.

Next, at a step S505, a pre-registration timer (set in the system controller 101) for obtaining the timing for later re-feeding the transfer sheet stopped at the pre-registration part is started, and at a step S506, the transfer sheet is detected by the pre-registration sensor 375, and in conformity with this detection, at a step S507, the second DC motor (M2) 403 is stopped to thereby stop the transfer sheet at the pre-registration part, whereafter if at a step S508, the delay timer which will be described later is in operation, the termination of the operation is waited for.

The delay timer is set by the sheet feeding control of the preceding transfer sheet when the feeding of the preceding transfer sheet is delayed over a predetermined time, and depending on the timing of the detection of the delay of the transfer sheet, the control of delaying the sheet supply (the judgement of the step S501), or delaying the re-feeding from the pre-registration part (the judgement of the step S508) is effected for the next transfer sheet.

Next, if at a step S509, the pre-registration timer is in operation, the termination of the operation is waited for, and at a step S510, the second DC motor (M2) 403 is operated to re-feed the transfer sheet stopped at the pre-registration part.

Next, when at a step S511, the transfer sheet is detected by the judgement sensor 379, at a step S512, whether a flag used by the judgement sensor (set in the RAM 101*c*) is set is judged, and if this flag is not set, at a step S513, the flag used by the judgement sensor is set, and shift is made to the step S523 of FIG. 6.

The flag used by the judgement sensor is set by the sheet feeding control of the preceding sheet when there are not over a predetermined time of early arrival and delay of the preceding sheet relative to a further preceding transfer sheet, and the detection of the delay and early arrival of the next transfer sheet is effected.

When at the step S512, it is judged that the flag used by the judgement sensor is set, at a step S514, the counted value of a judgement timer (set in the system controller 101) for detecting the delay and early arrival of the transfer sheet relative to the preceding transfer sheet is inputted, and at a step S515, whether the counted value of the judgement timer is delayed relative to the first reference value within a predetermined range (that is, whether the counted value has become over a value within the predetermined range) is judged, and when it is judged to be delayed, jump is made to the step S5151 of FIG. 7, where whether the counted value of the judgement timer is delayed relative to the second reference value within the predetermined range (that is, whether the counted value has become over a value within the predetermined range) is judged, and when it is judged to be delayed, shift is made to a step S5152, where the transfer sheet is stopped, and at a step S5153, a delay jam flag (set in the RAM 101*c*) is set, and shift is made to a step S5154, where jamming is displayed.

Also, when at a step S515, the counted value of the judgement timer is delayed relative to the first reference value within the predetermined range, but at the step S5151, the counted value of the judgement timer is within a predetermined range relative to the second reference value (that is, the counted value is below a value within the predetermined range), jump is made to a step S521.

When it is judged to be not delayed by the judgement of the step S515, at a step S516, whether the counted value of the judgement timer has early arrived relative to the third reference value within the predetermined range (that is, whether the counted value is below a value within the predetermined range) is judged, and when it is judged to have early arrived, jump is made to the step S5155 of FIG. 7, where whether the counted value of the judgement timer has early arrived relative to the fourth reference value within the predetermined range (that is, whether the counted value is below a value within the predetermined range) is judged, and when it is judged to have early arrived, shift is made to a step S5156, where the transfer sheet is stopped, and at a step S5157, an early arrival jam flag is set, and shift is made to the step S5154, where jamming is displayed.

Also, when at the step S516, the counted value of the judgement timer has early arrived relative to the third reference value within the predetermined range, but at the step S5155, the counted value of the judgement timer is within a predetermined range relative to the fourth reference value (that is, the counted value is over a value within the predetermined range), jump is made to the step S513, where the flag used by the judgement timer (set in the RAM 101*c*) is set, and jump is made to the step S523 of FIG. 6.

When it is judged to have not early arrived by the judgement of the step S516, at a step S517, the fourth DC motor (M4) 405, and the second DC motor (M2) 403, as required, are stopped to thereby stop the transfer sheet at the judging part.

Next, at a step S518, an early arrival timer for delaying the transfer sheet which has early arrived by the timing of early arrival is started, and when at a step S519, the operation of the early arrival timer is terminated, at a step S520, the fourth DC motor (M4) 405, and the second DC motor (M2) 403, as required, are operated to re-feed the transfer sheet.

Next, when at a step S521, the transfer sheet is delayed or has early arrived, a delay timer for delaying the feeding of the next transfer sheet by a predetermined time is started, and at a step S522, the flag used by the judgement sensor is reset so that the detection of the delay and early arrival by the judgement sensor 379 may not be effected for the next transfer sheet.

Next, at the step S523 of FIG. 6, an image output timer (set in the system controller 101) for making the feed timing of the transfer sheet and the timing of image formation on the photosensitive drum 30 coincident with each other is started, and when at a step S524, the operation of the image output timer is terminated, at a step S525, image formation on the photosensitive drum 30 is effected.

Next, at a step S526, a registration ON timer (set in the system controller 101) for obtaining the timing for later re-feeding the transfer sheet stopped at the registration part is started, and when at a step S527, the transfer sheet is detected by the registration sensor 377, a registration stop timer for the leading end of the transfer sheet to form a predetermined loop and be stopped by the registration roller 376 is started at a step S528, and when at a step S529, the operation of the registration stop timer is terminated, the fourth DC motor (M4) 405, and the second DC motor (M2) 403, as required, are stopped at a step S530 to thereby stop the transfer sheet at the registration part.

Next, when at a step S531, the operation of the registration ON timer started at the step S526 is terminated, the third DC motor (M3) 404, the fourth DC motor (M4) 405, and the second DC motor (M2) 403, as required, are driven at a step S532 to thereby re-feed the transfer sheet.

Next, at a step S533, whether the flag used by the judgement sensor for judging whether the detection of the delay and early arrival relative to the next transfer sheet by the judgement sensor 379 should be effected is set is judged, and if this flag is set (that is, the detection of the delay and early arrival is effected), the judgement timer for detecting the delay and early arrival of the next transfer sheet is started at a step S534, whereby the sheet feeding control is terminated.

Here, the sheet feeding control of the next transfer sheet is effected when the operation of the sheet supply timer started at the step S503 is terminated, whereafter the sheet feeding control is repetitively effected up to the last transfer sheet.

(Second Embodiment)

A second embodiment of the present invention will now be described, but the hardware of the apparatus of this embodiment is similar to that of the first embodiment shown in FIGS. 1 to 4 and therefore need not be described.

Figure 8:
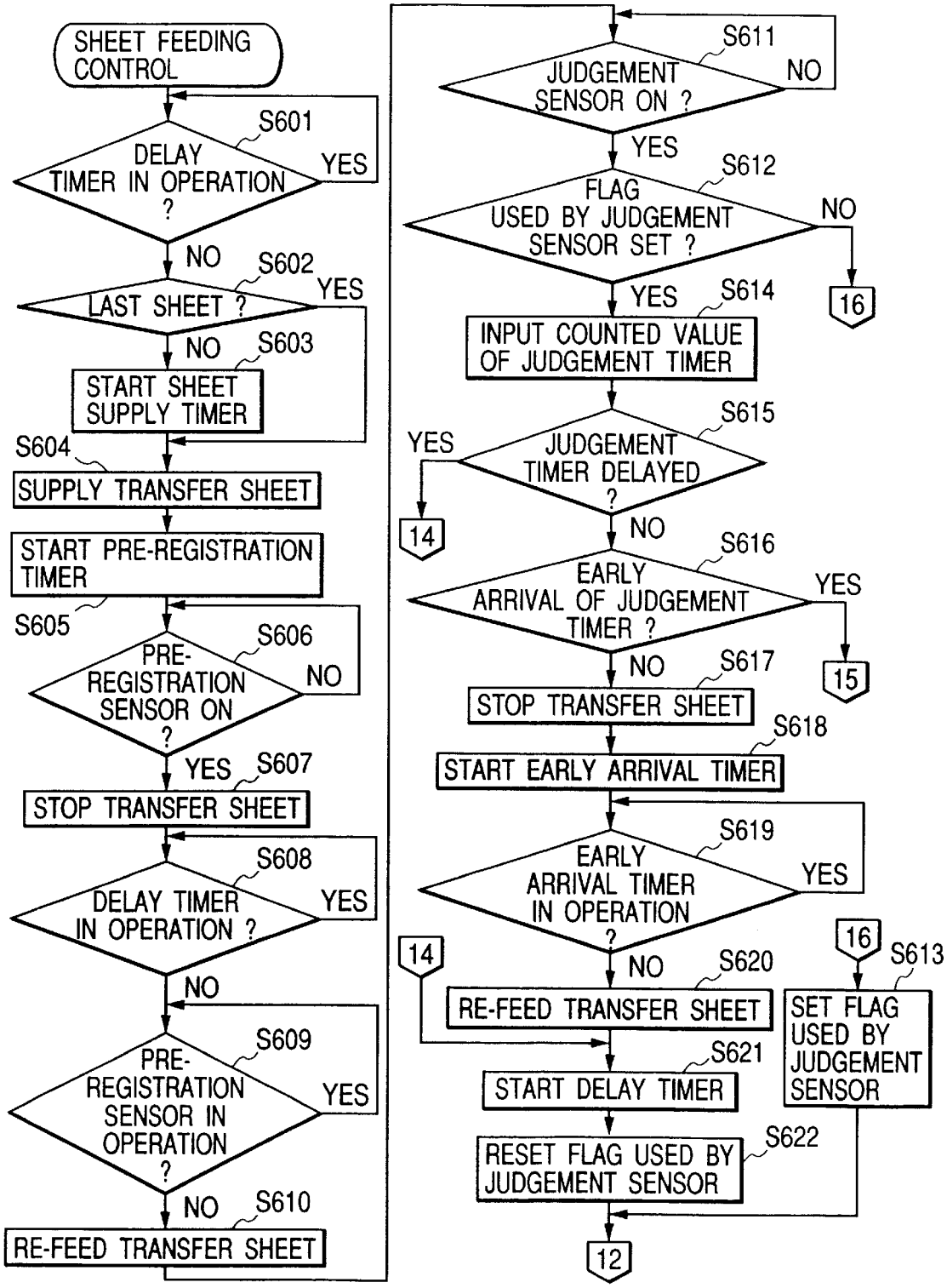
FIG. 8 s a flow chart showing the control procedure of a controller 101 in a second embodiment of the present invention.
Figure 9:
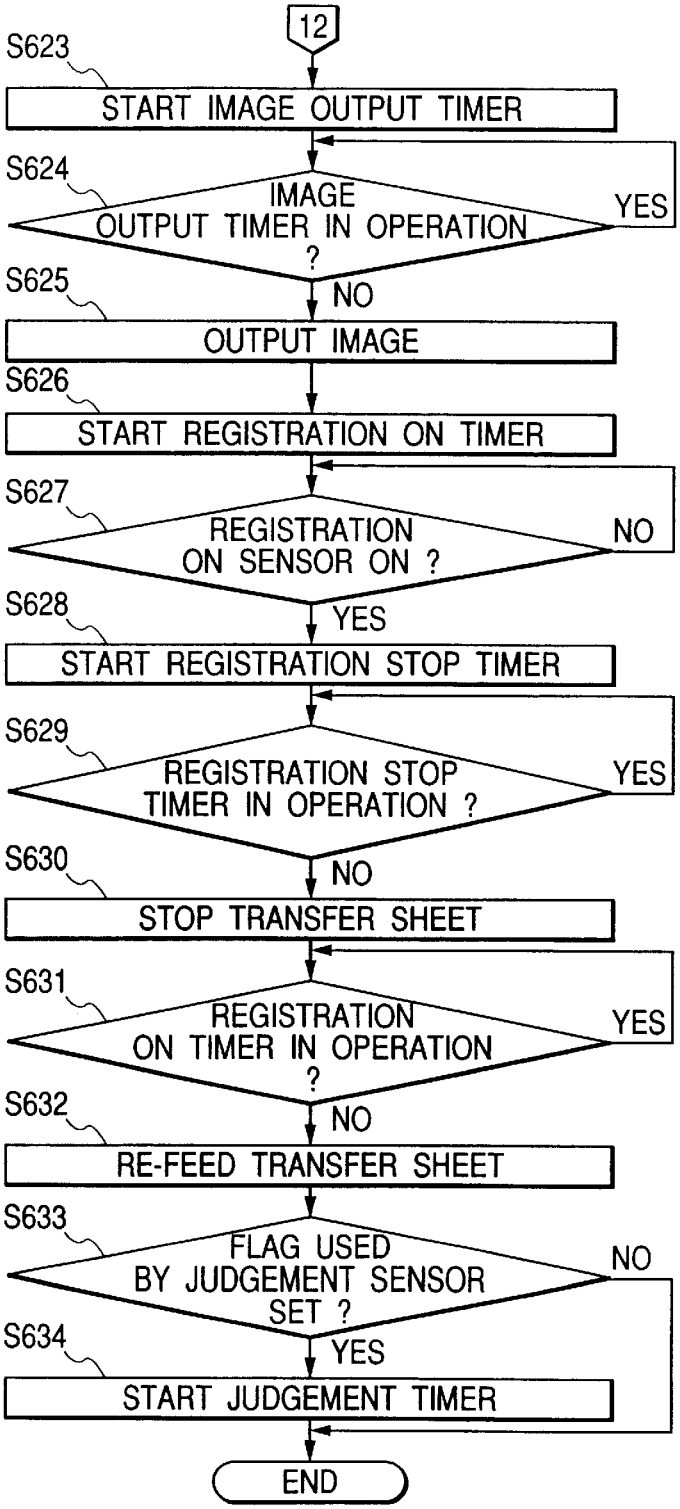
FIG. 9 is a flow chart showing a control procedure continued from the flow of FIG. 8.
Figure 10:
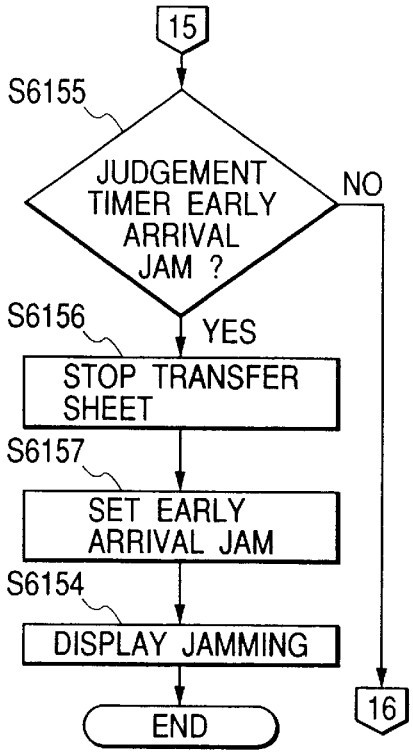
FIG. 10 is a flow chart showing a control procedure continued from the flow of FIG. 9.

FIGS. 8, 9 and 10 are flow charts showing the control procedure of a controller 101 which is the second embodiment of the image forming apparatus according to the present invention, and particularly show an example of the sheet feeding control of the transfer sheet.

As shown in FIG. 8, when the sheet feeding control is started, if at a step S601, a delay timer which will be described later is in operation, the termination of the operation is waited for.

Next, at a step S602, whether the transfer sheet which is about to be supplied is the last copy sheet is judged, and if it is not the last sheet, at a step S603, a sheet supply timer for obtaining the timing of the sheet feeding control of the next transfer sheet is started, and at a step S604, the A roller 371 is operated to thereby supply the transfer sheet.

Next, at a step S605, a pre-registration timer for obtaining the timing for later re-feeding the transfer sheet stopped at the pre-registration part is started, and at a step S606, the transfer sheet is detected by the pre-registration sensor 375, and at a step S607, the second DC motor (M2) 403 is stopped, whereby the transfer sheet is stopped at the pre-registration part, whereafter if at a step S608, a delay timer which will be described later is in operation, the termination of the operation is waited for. The delay timer is set by the sheet feeding control of the preceding transfer sheet when the feeding of the preceding transfer sheet is delayed by over a predetermined time, and depending on the timing of the detection of the delay of the transfer sheet, the control of delaying the sheet supply relative to the next transfer sheet (the judgement of the step S601), or delaying the re-feeding from the pre-registration part (the judgement of the step S608) is effected.

Next, if at a step S609, the pre-registration timer is in operation, the termination of the operation is waited for, and at a step S610, the second DC motor (M2) 403 is operated to thereby re-feed the transfer sheet stopped at the pre-registration part.

Next, when at a step S611, the transfer sheet is detected by the judgement sensor 379, at a step S612, whether the flag used by the judgement sensor is set is judged, and if it is not set, the flag used by the judgement sensor is set at a step S613, and jump is made to the step S623 of FIG. 9. The flag used by the judgement sensor is set by the sheet feeding control of the preceding sheet when there are not over a predetermined time of early arrival and delay of the preceding transfer sheet relative to the further preceding transfer sheet, and the detection of the delay and early arrival of the next transfer sheet is effected.

When at the step S612, it is judged that the flag used by the judgement sensor is set, at a step S614, the counted value of the judgement timer for detecting the delay and early arrival of the transfer sheet relative to the preceding transfer sheet is inputted, and at a step S615, whether the counted value of the judgement timer is delayed relative to the reference value thereof within a predetermined range (that is, whether the counted value is over a value within the predetermined range) is judged, and when it is judged to be delayed, jump is made to a step S621.

When it is judged to be not delayed by the judgement of the step S615, whether the counted value of the judgement timer is early arrival relative to the third reference value within the predetermined range (that is, whether the counted value is below a value within the predetermined range) is judged at a step S616, and when it is judged to be early arrival, jump is made to the step S6155 of FIG. 10, where whether the counted value of the judgement timer is early arrival relative to the fourth reference value within the predetermined range (that is, whether the counted value is below a value within the predetermined range) is judged, and when it is judged to be early arrival, shift is made to a step S6156, where the transfer sheet is stopped, and at a step S6157, an early arrival jam flag is set, and shift is made to a step S6154, where jamming is displayed.

Also, when at the step S616, the counted value of the judgement timer is early arrival relative to the third reference value within the predetermined range, but at the step S6155, the counted value of the judgement timer is within a predetermined range relative to the fourth reference value (that is, the counted value is over a value within the predetermined range), jump is made to the step S613, where the flag used by the judgement timer is set, and shift is made to the step S623 of FIG. 9.

When it is judged to have not early arrived by the judgement of the step S616, the fourth DC motor (M4) 405, and the second DC motor (M2) 403, as required, are stopped at a step S617 to thereby stop the transfer sheet at the judging part.

Next, at a step S618, an early arrival timer for stopping and delaying a transfer sheet which has early arrived by the timing of the early arrival is started, and when at a step S619, the operation of the early arrival timer is terminated, the fourth DC motor (M4) 405, and the second DC motor (M2) 403, as required, are operated at a step S620 to thereby re-feed the transfer sheet.

Next, when at a step S621, the transfer sheet is delayed or has early arrived, a delay timer for delaying the feeding of the next transfer sheet by a predetermined time is started, and at a step S622, the flag used by the judgement sensor is reset so that the detection of the delay and early arrival by the judgement sensor 379 may not be effected for the next transfer sheet.

Next, at the step S623 of FIG. 9, an image output timer for making the feed timing of the transfer sheet and the timing of image formation on the photosensitive drum 30 coincident with each other is started, and when at a step S624, the operation of the image output timer is terminated, image formation on the photosensitive drum 30 is effected at a step S625.

Next, at a step S626, a registration ON timer for obtaining the timing for later re-feeding the transfer sheet stopped at the registration part is started, and when at a step S627, the transfer sheet is detected by the registration sensor 377, a registration stop timer for the leading end of the transfer sheet to form a predetermined loop by the registration rollers 376 and be stopped is started at a step S628, and when at a step S629, the operation of the registration stop timer is terminated, the fourth DC motor (M4) 405, and the second DC motor (M2) 403, as required, are stopped at a step S630 to thereby stop the transfer sheet at the registration part.

Next, when at a step S631, the operation of the registration ON timer started at the step S626 is terminated, the third DC motor (M3) 404, the fourth Dc motor (M4) 405, and the second DC motor (M2) 403, as required, are operated at a step S632 to thereby re-feed the transfer sheet.

Next, at a step S633, whether a flag used by the judgement sensor for judging whether the detection of delay and early arrival relative to the next transfer sheet by the judgement sensor 379 should be effected is set is judged, and when the flag is set (that is, the detection of delay and early arrival is effected), whether the preceding transfer sheet has passed the registration sensor 377 is judged at a step S635, and after the passage is detected, a judgement timer for detecting the delay and early arrival of the next transfer sheet is started at a step S634, and the sheet feeding control is completed.

The sheet feeding control of the next transfer sheet is effected when the operation of the sheet supply timer started at the step S603 is terminated, whereafter the sheet feeding control is repetitively effected up to the last transfer sheet.

(Other Embodiments)

The present invention may be applied to a system comprised of a plurality of apparatuses (e.g. a host computer, an interface apparatus, a reader, a printer, etc.) or may be applied to an apparatus comprising a single apparatus (e.g. a copying machine, a facsimile apparatus or the like).

Of course, the object of the present invention is also achieved by supplying a system or an apparatus with a recording medium (memory medium) having recorded thereon the program code of software realizing the functions of the aforedescribed embodiments, and by the computer (or the CPU or MPU) of the system or the apparatus reading out the program code stored in the recording medium and executing it.

In this case, the program code itself read out from the recording medium realizes the functions of the aforedescribed embodiments, and the recording medium having recorded thereon the program code constitutes the present invention.

As the recording medium for recording the program code thereon and recording such variable data as tables thereon, use can be made, for example, of a floppy disc (FD), a hard disc, an optical disc, a magneto-optical disc, CD-ROM, CD-R, a magnetic tape, a non-volatile memory card (IC memory card), a ROM or the like.

Of course, the present invention also includes a case where not only the functions of the aforedescribed embodiments are realized by the computer executing the read-out program code, but on the basis of the instructions of the program code, an OS (operating system) working on the computer or the like effects part or the whole of actual processing and by that processing, the functions of the aforedescribed embodiments are realized.

As described above, the present invention has transfer material supplying means for successively supplying transfer materials contained in transfer material storing means, first registration correcting means for taking the registration of the supplied transfer material, second registration correcting means for taking the registration of the transfer material between the first registration correcting means and an image transfer position, transfer material interval detecting means for detecting the interval between the transfer materials provided between the first registration correcting means and the second registration correcting means, judging means for judging whether the transfer material interval is a predetermined interval, and control means for controlling the transfer material supplying means and the first registration correcting means independently of each other in conformity with the result of the judgement of the judging means, and the predetermined interval which is the judgement reference of the judging means has at least two intervals and therefore, even when other transfer materials than designated transfer sheets are set, stable transfer sheet feeding control can be accomplished by an early arrival sequence and a delay sequence.

Also, according to the present invention, jam displaying means enables jamming to be displayed and informed to the operator when the transfer material interval is judged to be outside an allowable design value for some factor or other.

Thus, according to the present invention, the higher speed of the image forming apparatus can be easily realized without the image processing speed being changed.

(Third Embodiment)

Figure 11:
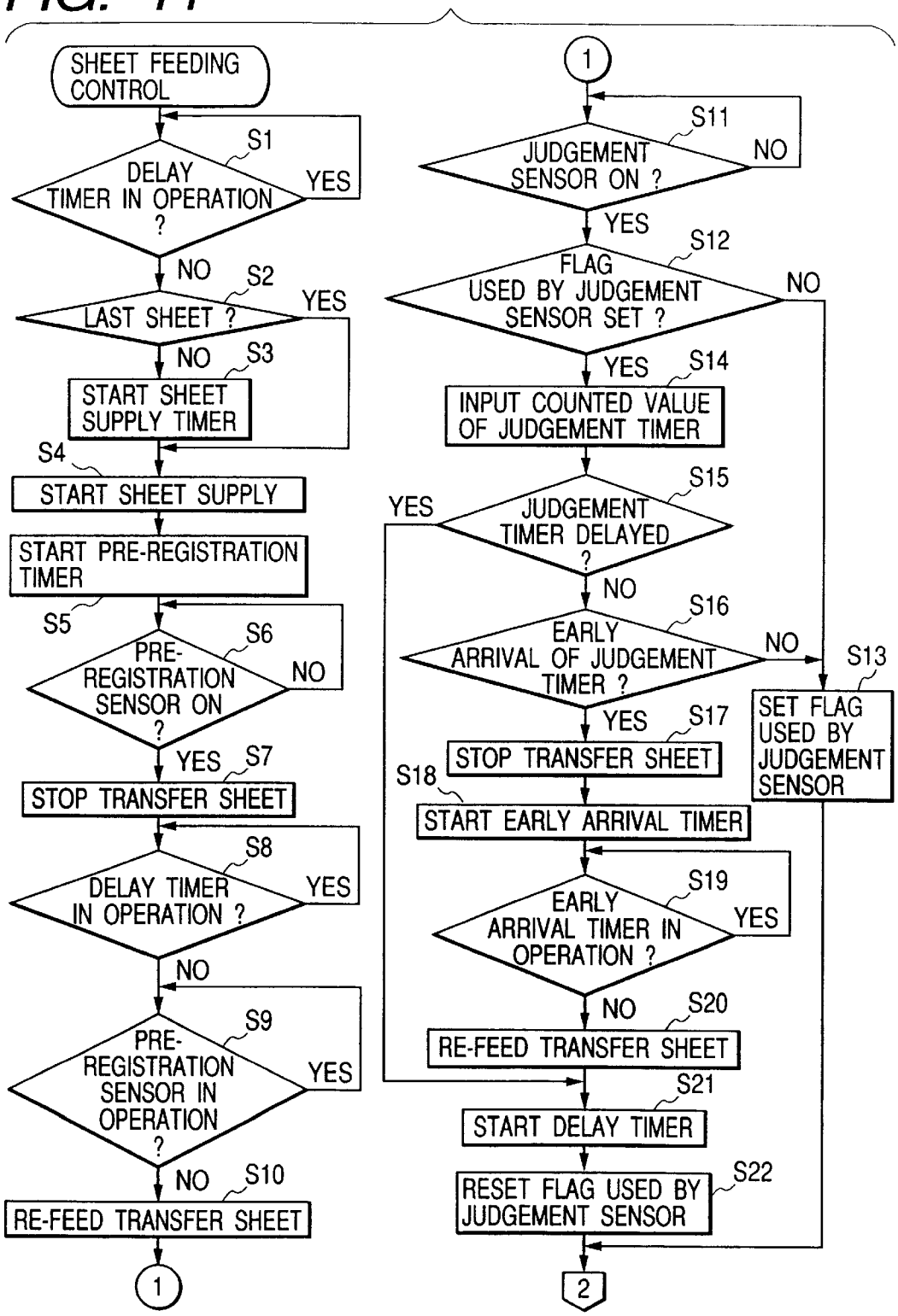
FIG. 11 is a flow chart illustrating the operation of a third embodiment of the control system of the image forming apparatus.
Figures 12, 13:
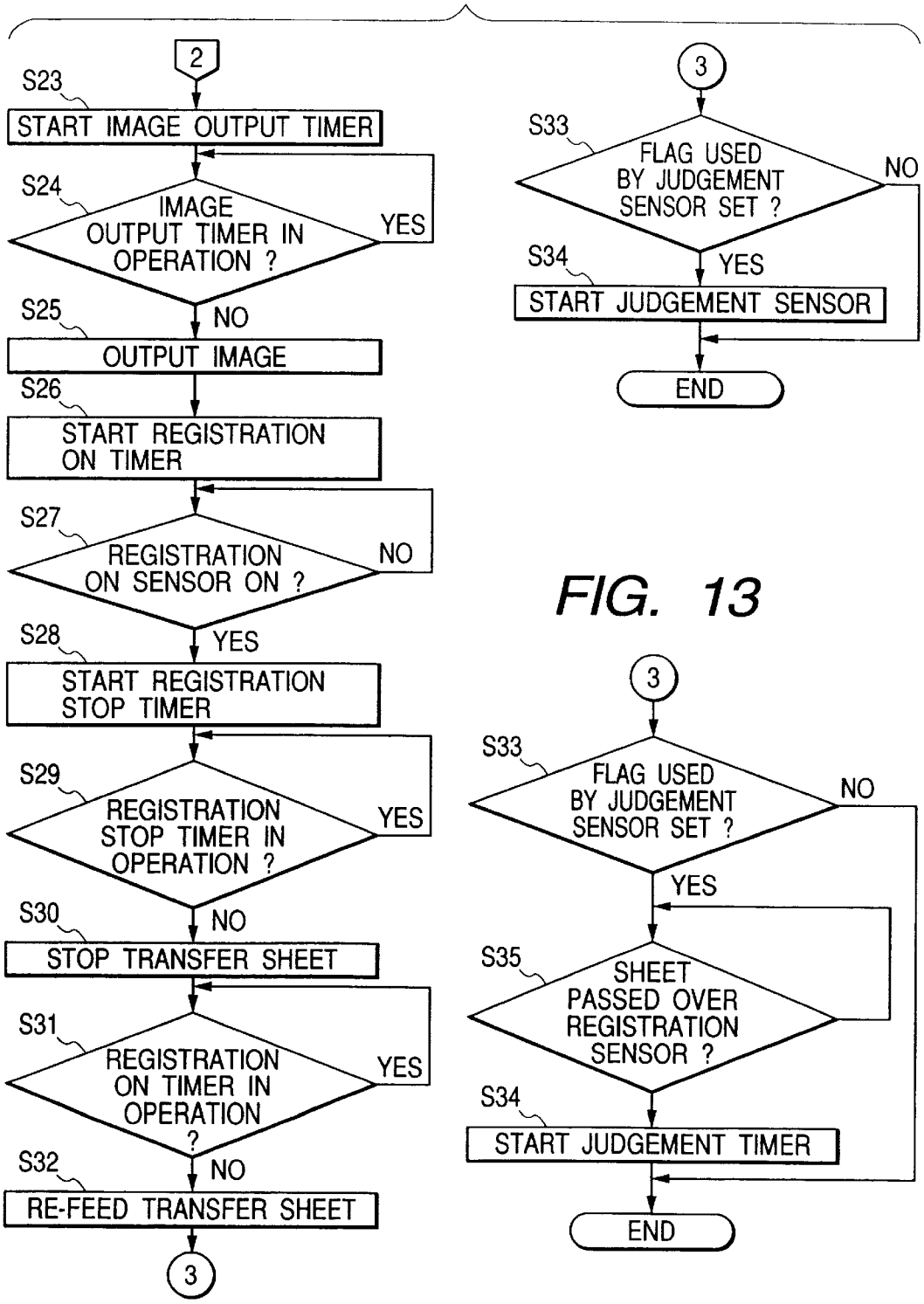
FIG. 12 is a flow chart continued from FIG. 11.
FIG. 13 is a flow chart illustrating the operation of the control system of an image forming apparatus according to a fourth embodiment of the present invention.

A third embodiment of the control in the feeding portion of the above-described construction will now be described with reference to FIGS. 11 and 12. When the feeding control is started, whether a delay timer which will be described later is in operation is judged (step S1), and if it is in operation, the termination of the operation is waited for. If it is not in operation, whether the transfer material P which is about to be fed is the last sheet to be outputted is discriminated (step S2), and if it is not the last sheet, a feeding timer for obtaining the timing of the feeding control of the next transfer material P is started (step S3).

Next, when the pickup roller 34 is operated to start the feeding of the transfer material P (step S4), a pre-registration timer for later obtaining the re-feed timing of the pre-registration correcting portion is started (step S5). When the transfer material P is detected by the pre-registration sensor 45 (step S6), the DC motor 40 is stopped to thereby stop the pre-registration roller 39, and if the delay timer is in operation, the termination of the operation is waited for (step S8). When the operation of the delay timer is terminated, if the pre-registration timer is in operation, the termination of the operation is waited for (step S9), and the DC motor 40 is operated to thereby re-feed the transfer material P stopped at the pre-registration correcting part.

The delay timer is set by the feeding control of the preceding transfer material P when the feeding of the preceding transfer material P is delayed by over a predetermined time. By this delay timing, the control of delaying the feeding relative to the next transfer material P (step S1) or the control of delaying the re-feeding from the pre-registration correcting part (step S8) is effected.

Next, when the transfer material P is detected by the judgement sensor 46 (step S11), whether a flag used by the judgement sensor for judging by the use of the judgement sensor 46 whether the detection of delay and early arrival should be effected is set is judged (step S12), and if it is not set, the flag used by the judgement sensor is set (step S13), and jump is made to a step S23. The flag used by the judgement sensor is set by the feeding control of the preceding transfer material P when in the feeding of the preceding transfer material P, there are not over a predetermined time of early arrival and delay relative to the still further preceding transfer material P, and the detection of the delay and early arrival of the next transfer material is effected.

On the other hand, when it is judged that the flag used by the judgement sensor has been set (step S12), the counted value of a judgement timer for detecting the delay or early arrival relative to the preceding transfer material P is inputted (step S14), and whether the counted value of the judgement timer is delayed relative to a reference value within a predetermined range (whether the counted value is over a value within the predetermined range) is judged (step S15), and when it is judged to be delayed, jump is made to a step S21.

Also, when it is judged to be not delayed (step S15), whether the counted value of the judgement timer is early arrival relative to the reference value within the predetermined range (whether the counted value is below the value within the predetermined range) is judged (step S16), and when it is judged to be not early arrival, the flag used by the judgement timer is set (step S13), and jump is made to a step S23. When it is judged to be early arrival (step S16), the registration fore roller 41, and the pre-registration roller 39, as required, are stopped to thereby stop the transfer material P at the judging part (step S17).

Next, an early arrival timer for stopping and delaying a transfer material P which has early arrived by the timing of early arrival is started (step S18), and when the operation of the early arrival timer is terminated (step S19), the registration fore roller 41 and the pre-registration roller 39 are driven to re-feed the transfer material P.

When the transfer material is delayed or has early arrived, a delay timer for delaying the feeding of the next transfer material P by a predetermined time is started (step S21), and the flag used by the judgement sensor is reset so that the detection of delay and early arrival by the judgement sensor 46 may not be effected for the next transfer material P (step S22).

Next, an image output timer for making the timing of conveyance of the transfer material P and the timing of image formation on the photosensitive drum 30 coincident with each other is started (step S23), and when the operation of the image output timer is terminated (step S24), the image formation on the photosensitive drum 30 is effected.

A registration ON timer for later obtaining the timing for re-feeding the transfer material P stopped at the registration part is started (step S26), and when the transfer material P is detected by the registration sensor 47 (step S27), a registration stop timer for the leading end of the transfer material P to form a predetermined loop by the registration roller 43 and be stopped is started (step S28).

When the operation of the registration stop timer is terminated (step S29), the registration fore roller 41, and the pre-registration roller 39, as required, are stopped to thereby stop the transfer material P at the registration part (step S30). When the operation of the registration ON timer started at the step S26 is terminated (step S31), the registration roller 43, the registration fore roller 41, and the pre-registration roller 39, as required, are operated (step S32) to thereby re-feed the transfer material P.

Next, whether the flag used by the judgement sensor is set is judged (step S33) and when it is set (the detection of delay and early arrival is effected), the judgement timer is started (step S34), and the feeding control is completed. The feeding control of the next transfer material P is effected when the operation of the feeding timer started at the step S3 is terminated, whereafter the feeding control is repetitively effected up to the last transfer material P.

As described above, two registration means are provided and they are designed to be controlled independently of each other, whereby it is possible to improve the conveyance accuracy of the transfer materials very much. Accordingly, it becomes possible to narrow the interval between the transfer materials, and the number of output sheets can be increased, that is, the speedup of the image forming speed can be easily realized, even if the speed of the image forming process is not changed.

[Fourth Embodiment]

A fourth embodiment of the image forming apparatus according to the present invention will now be described with reference to FIG. 13. FIG. 13 is a flow chart illustrating the operation of the control system of the image forming apparatus according to the present embodiment, and in this embodiment, portions overlapping the portions of the first embodiment in description are given the same reference numerals and need not be described.

In the present embodiment, when the flag used by the judgement sensor is set (the detection of delay and early arrival is effected) after whether the flag is set is judged (step S33), whether the preceding transfer material has passed over the registration sensor 47 is judged (step S35). The judgement timer is started (step S34) after the passage has been detected, whereafter the feeding control is completed.

The feeding control of the next transfer material is effected when the operation of the feeding timer started at the step S3 has been terminated. Thereafter, by the above-described procedure being repeated, the feeding control is repetitively effected up to the last transfer material. As described above, design is made such that the interval between transfer materials is measured with the passage of the preceding transfer material over the main registration correcting part which is the second registration means as the reference, whereby it becomes possible to control the inter-sheet more reliably.

As described above, the image forming apparatus according to the present invention has two registration means, and these two registration means and the transfer material feeding means are designed to be drive-controlled independently of one another, whereby it is possible to improve the conveyance accuracy of the transfer materials very much. Accordingly, it becomes possible to narrow the interval between transfer materials, and the number of output sheets can be increased, that is, the speedup of the image forming speed can be easily realized, even if the speed of the image forming process is not changed.

(Fifth Embodiment)

Figure 14:
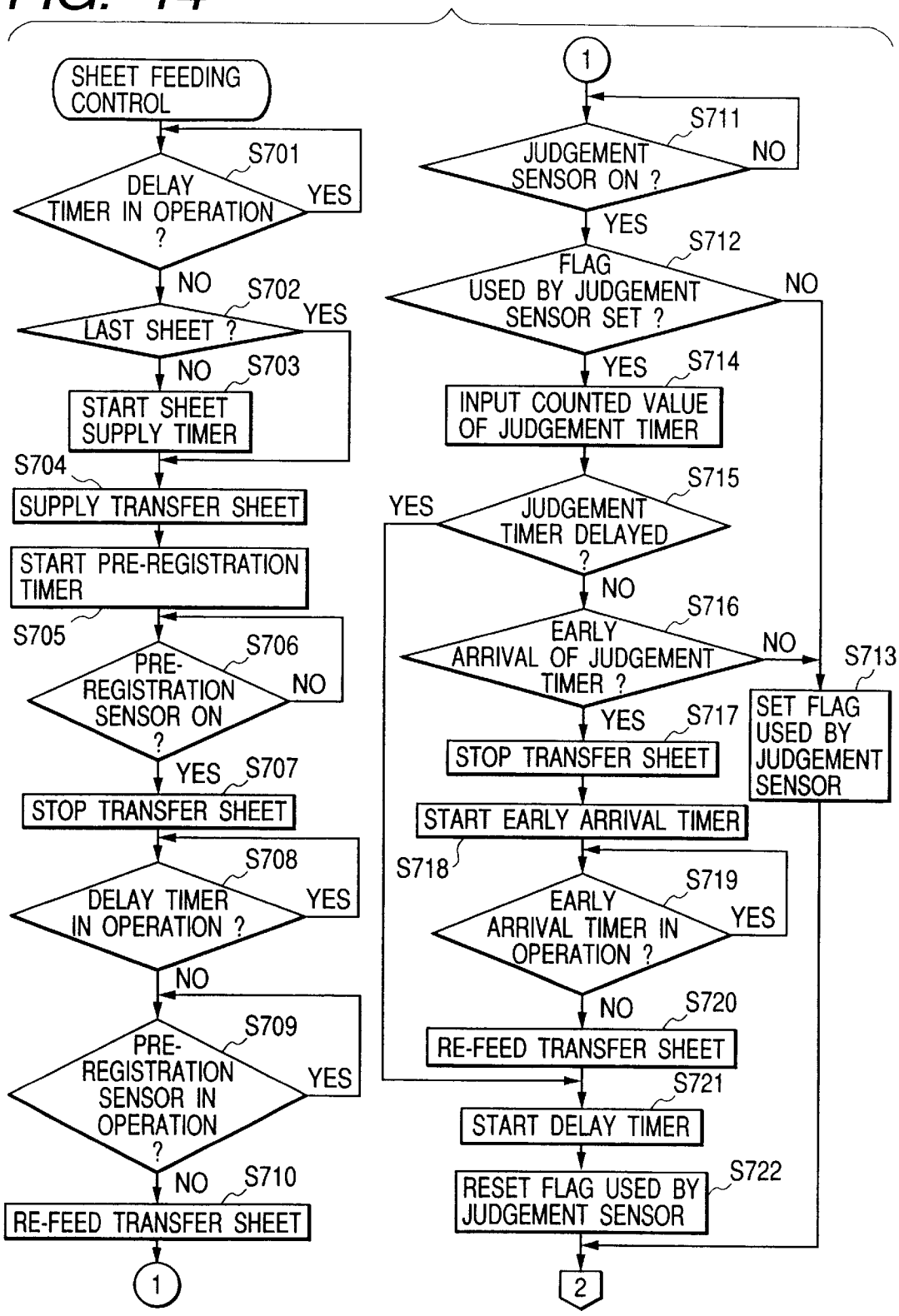
FIG. 14 is a flow chart illustrating the operation of a fifth embodiment of the control system.
Figure 15:
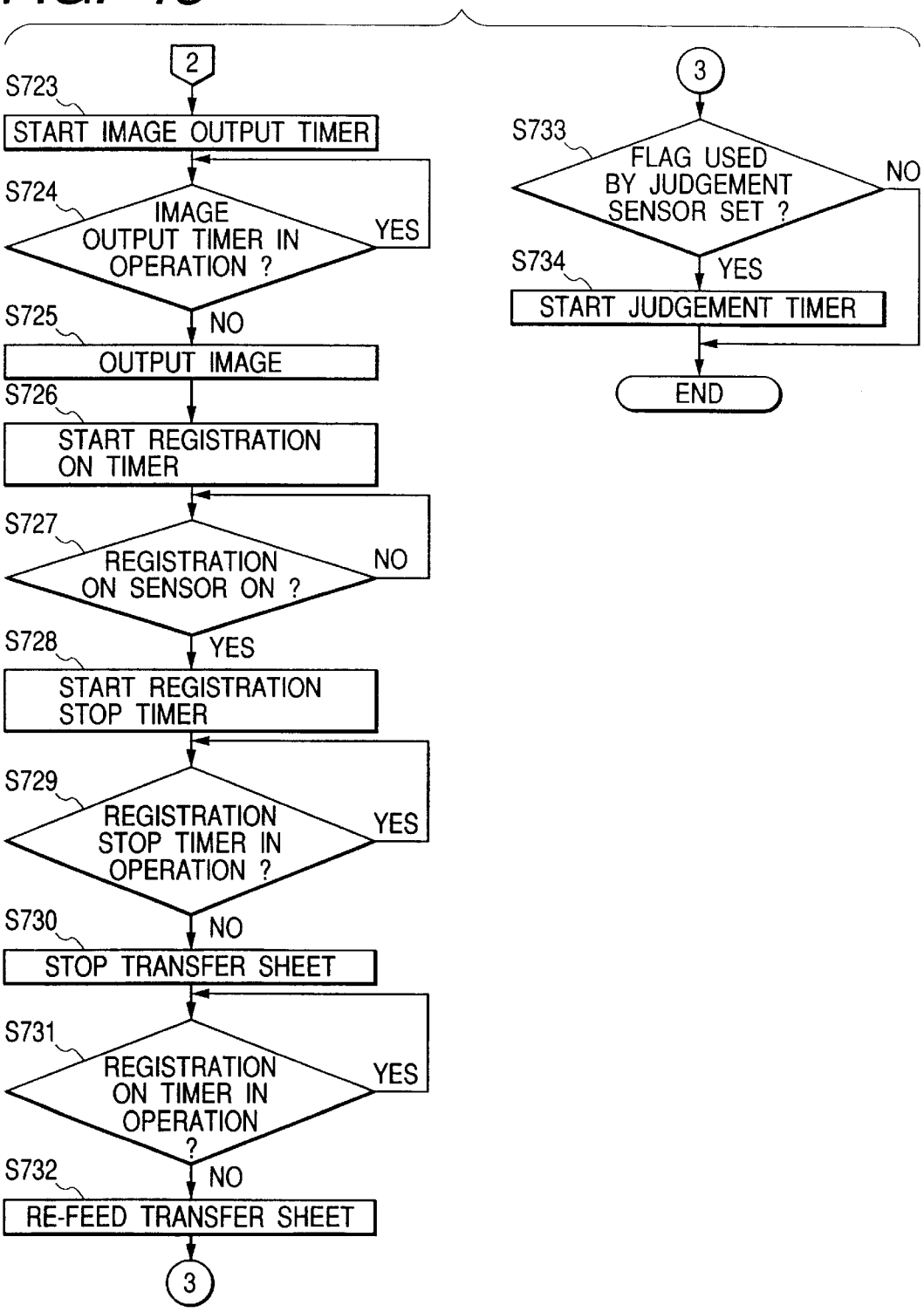
FIG. 15 is a flow chart continued from FIG. 14.

FIGS. 14 and 15 are flow charts showing a fifth embodiment of the control according to the present invention, and show an example of the sheet feeding control of transfer sheets.

When the sheet feeding control is started, if at a step S701, a delay timer which will be described later is in operation, the termination of the operation is waited for.

Next, at a step S702, a transfer sheet to be supplied is counted by the CPU 101*a* each time it is fed out of the sheet supply cassette 36, and the system controller 101 judges whether the transfer sheet is the last sheet, and if it is not the last sheet, at a step S703, a sheet supply timer, not shown, is started to obtain the timing for the sheet feeding control of the next transfer sheet and substantially at the same time, at a step S704, the A roller 371 is operated to feed the transfer sheet.

Next, at a step S705, a pre-registration timer for later obtaining the timing for re-feeding the transfer sheet stopped at the pre-registration correcting part 45 is started immediately after a transfer sheet has been supplied from the sheet supply cassette 36, and at a step S706, the transfer sheet is detected by the pre-registration sensor 375, and at a step S707, the DC motor M2 (403) is stopped to thereby stop the transfer sheet at the pre-registration correcting part 45, whereafter if at a step S708, a delay timer which will be described later is in operation, the termination of the operation is waited for. In the meantime, the transfer sheet is preliminarily registered. Here, the delay timer is set by the sheet feeding control of the preceding transfer sheet when the feeding of the preceding transfer sheet is delayed by over a predetermined time, and depending on the timing of the detection of the delay of the transfer sheet, the control of delaying sheet supply (the judgement of the step S701) or the control of delaying the re-feeding from the pre-registration correcting part 45 (the judgement of the step S708) is effected for the next transfer sheet.

Next, if at a step S709, the pre-registration timer is in operation, the termination of the operation is waited for, and at a step S710, the DC motor M2 (403) is operated to thereby re-feed the transfer sheet stopped at the pre-registration correcting part 45.

Next, when at a step S711, the transfer sheet is detected by the judgement sensor 379, whether the flag used by the judgement sensor is set judged at a step S712, and if it is not set, the flag used by the judgement sensor is set at a step S713, and jump is made to a step S723. The flag used by the judgement sensor is set by the sheet feeding control of the preceding sheet when in the feeding of the preceding transfer sheet, there are not over a predetermined time of early arrival and delay relative to the further preceding transfer sheet, and the detection of the delay and early arrival of the next transfer sheet is effected.

When at the step S712, it is judged that the flag used by the judgement sensor is set, at a step S714, the counted value of the judgement timer for detecting the delay and early arrival of the transfer sheet relative to the preceding transfer sheet is inputted, and at a step S715, the counted value of the judgement timer is sent to the CPU 101*a*, and the system controller 101 judges whether it is delayed relative to a reference value within a predetermined range (whether the counted value is over a value within the predetermined range), and when it is judged to be delayed, jump is made to a step S721.

There are the following three cases for the start and termination of the operation of the judgement timer, and any of those cases will do.

In a first case, the rotation of the registration rollers 376 is started immediately after the feeding of the preceding transfer sheet has been started, and is terminated when the leading end of the next transfer sheet is detected by the judgement sensor 379.

In a second case, the rotation of the registration rollers 376 is started immediately after the feeding of the preceding transfer sheet has been completed, and is terminated when the leading end of the next transfer sheet is detected by the judgement sensor 379.

In a third case, the rotation of the registration rollers 376 is started when the leading end of the preceding transfer sheet is detected by the judgement sensor 379, and is terminated when the leading end of the transfer sheet fed next is detected.

When by the judgement of the step S715, it is judged to be not delayed (have early arrived or be normal), at a step S716, whether the counted value of the judgement timer is early arrival relative to the reference value within a predetermined range (whether the counted value is below a value within the predetermined range) is judged, and when it is judged to be not early arrival, at a step S713, the flag used by the judgement sensor is set, and jump is made to a step S723.

When by the judgement of the step S716, it is judged to be early arrival, at a step S717, the DC motor M4 (405), and the DC motor M2 (403), as required, are stopped to thereby stop the transfer sheet at the judging part.

Next, at a step S718, an early arrival timer for stopping and delaying the transfer sheet which has early arrived by the timing of the early arrival is started, and when at a step S719, the operation of the early arrival timer is terminated, the DC motor M4 (405), and the DC motor M2 (403), as required, are operated to thereby re-feed the transfer sheet.

Next, at a step S721, a delay timer for delaying the feeding of the next transfer sheet by a predetermined time when the transfer sheet has been delayed or has early arrived is started, and at a step 722, the flag used by the judgement sensor is reset so that the detection of delay and early arrival by the judgement sensor 379 may not be effected for the next transfer sheet.

Next, at a step S723, an image output timer for making the timing of the feeding of the transfer sheet and the timing of image formation on the photosensitive drum 30 coincident with each other is started, and when at a step S724, the operation of the image output timer is terminated, the image formation on the photosensitive drum 30 is effected at a step S725.

Next, at a step S726, a registration ON timer for obtaining the timing for later re-feeding the transfer sheet stopped at the registration part 47 is started. At this time, the DC motor M3 (404) is stopped. When at a step S727, the transfer sheet is detected by the registration sensor 377, at a step S728, a registration stop timer for the leading end of the transfer sheet to form a predetermined loop by the registration rollers 376 and be stopped is started, and when at a step S729, the operation of the registration stop timer is terminated, at a step S730, the DC motor M4 (405), and the DC motor M2 (403), as required, are stopped to thereby stop the transfer sheet at the registration part 47.

Next, when at a step S731, the operation of the registration ON timer started at the step S726 is terminated, at a step S732, the DC motor M3 (404), the DC motor M4 (405), and the DC motor M2 (403), as required, are operated to thereby re-feed the transfer sheet.

Next, at a step S733, whether the flag used by the judgement sensor for judging whether the detection of delay and early arrival by the judgement sensor 379 should be effected for the next transfer sheet is set is judged, and when it is set (the detection of delay and early arrival is effected), at a step S734, a judgment sensor for detecting the delay and early arrival of the next transfer sheet is started, and the sheet feeding control is completed.

The sheet feeding control of the next transfer sheet is effected when the operation of the sheet supply timer started at the step S703 has been terminated, whereafter the sheet feeding control is repetitively effected up; to the last transfer sheet.

While in the above-described embodiments, the feeding control of transfer sheets in the digital copying machine is effected, the present invention is not restricted to the digital copying machine, but can also be applied to other page printers such as an analog copying machine, a color copying machine and a printer.

The sheet conveying apparatus of the present invention feeds sheets from the sheet supporting means by the sheet feeding means, and when the sheets are being conveyed by the first, second and third sheet conveying means, the sheet interval judging means detects the interval between the sheets, and judges whether the interval is a predetermined interval, and on the basis of this judgement, the control means controls at least the first and second sheet conveying means, and when the interval between the sheets is shortened, the sheets can be conveyed at a predetermined interval.

The image forming apparatus is provided with the sheet conveying apparatus which can convey sheets at a predetermined interval when the interval between the sheets is shortened and therefore, the image forming process can be accurately carried out at a high speed without the image process speed being changed.

What is claimed is:

1. An image forming apparatus provided with:

sheet feeding means for separating and feeding sheets supported on sheet supporting means;

first registration means for correcting the position of the leading end of the sheet fed by said sheet feeding means;

second registration means disposed downstream of said first registration means with respect to the sheet feeding direction for correcting the position of the leading end of the sheet;

sheet interval detecting means disposed between said first registration means and said second registration means for detecting the interval between the sheets; and means for drive-controlling said sheet feeding means, said first registration means and said second registration means by a signal from said sheet interval detecting means.

2. An image forming apparatus according to claim 1, characterized in that said sheet feeding means, said first registration means and said second registration means can be drive-controlled independently of one another.

3. An image forming apparatus according to claim 1, characterized in that the initial driving when the sheet is fed by said sheet feeding means is one of continuously increased and stepwisely increased in speed during the time from a stoppage till a steady rotation.

4. An image forming apparatus according to claim 1, characterized by sheet interval judging means for judging whether the sheet interval detected by said sheet interval detecting means is a predetermined interval.

5. An image forming apparatus according to claim 4, characterized in that said sheet interval judging means judges the sheet interval with the start timing of said second registration means as the reference.

6. An image forming apparatus according to claim 4, characterized in that said sheet interval judging means judges by the time from after the passage of the sheet has been detected by said sheet interval detecting means until the next sheet is detected.

7. An image forming apparatus according to claim 4, characterized in that said sheet interval judging means judges the sheet interval with the timing at which said sheet has passed said second registration means as the reference.

8. An image forming apparatus according to claim 1, characterized by delay judging means for judging a delay when the sheet interval detected by said sheet interval detecting means is wider than a predetermined interval.

9. An image forming apparatus characterized by:

sheet feeding means for successively feeding sheets supported on sheet supporting means;

first registration correcting means for correcting the registration of said sheets fed from said sheet supporting means by said sheet feeding means;

second registration correcting means for correcting the registration of the sheet between said first registration correcting means and an image recording position;

sheet interval detecting means provided between said first registration correcting means and said second registration correcting means for detecting the interval between the sheets;

judging means for judging whether the interval between the sheets detected by said sheet interval detecting means is a predetermined interval; and control means for controlling said sheet feeding means and said first registration correcting means independently of each other in conformity with the result of the judgment of said judging means;

said judging means having at least two judgement references of said predetermined interval.

10. An image forming apparatus according to claim 9, characterized in that said sheet interval detecting means has a judgement sensor provided between said first registration correcting means and said second registration correcting means for detecting said sheet, and a judgement timer adapted to start time counting in conformity with the detection by said judgement sensor, and said judgement references of said judging means are a plurality of predetermined values compared with the counted value of said judgement timer.

11. An image forming apparatus according to claim 9 or 10, characterized in that said judging means judges a delay in sheet arrival timing which exceeds a first judgement reference, judges delay jam for sheet arrival timing which exceeds a second judgement reference, judges early arrival jam for sheet arrival timing which does not exceed a third judgement reference, and judges early arrival jam for sheet arrival timing which does not exceed a fourth judgement reference, and said control means controls said sheet feeding means and said first registration correcting means independently of each other in conformity with the results of the respective judgements.

12. An image forming apparatus according to claim 11, characterized in that the values of said first, second, third and fourth judgement references are in the relation that fourth judgement reference<third judgement reference<first judgement reference<second judgement reference.

13. An image forming apparatus according to claim 9, characterized by being a digital image forming apparatus using the electrophotographic method.

14. An image forming method characterized by:

the sheet feeding step of successively feeding sheets supported on sheet supporting means;

the first registration correcting step of correcting the registration of said sheets fed from said sheet supporting means at a first registration correcting position;

the second registration correcting step of correcting the registration of the sheets between said first registration correcting position and an image recording position at a second registration correcting position;

the sheet interval detecting step of detecting the interval between the sheets provided between said first registration correcting position and said second registration correcting position;

the judging step of judging whether the interval between said sheets detected by said sheet interval detecting step is a predetermined interval; and the controlling step of controlling said sheet feeding step and said first registration correcting step independently of each other in conformity with the result of the judgement at said judging step;

said judging step having at least two judgement references of said predetermined interval.

15. An image forming method according to claim 14, characterized in that said sheet interval detecting step uses a judgement sensor provided between said first registration correcting position and said second registration correcting position for detecting said sheets, and a judgement timer adapted to start time counting in conformity with the detection by said judgement sensor, and said judgement references of said judging step are a plurality of predetermined values compared with the counted value of said judgement timer.

16. An image forming method according to claim 14 or 15, characterized in that said judging step judges a delay in sheet arrival timing which exceeds a first judgement reference, judges delay jam for sheet arrival timing which exceeds a second judgment reference, judges early arrive for sheet arrival timing which does not exceed a third judgement reference, and judges early arrival jam for sheet arrival timing which does not exceed a fourth judgement reference, and said controlling step controls said sheet feeding step and said first registration correcting step independently of each other in conformity with the results of the respective judgements.

17. An image forming method according to claim 16, characterized in that the values of said first, second, third and fourth judgement references are in the relation that fourth judgement reference<third judgement reference<first judgement reference<second judgement reference.

18. A data storage medium having recorded thereon a control program for executing steps for effecting image forming control by a computer, characterized in that said program is provided with:

the sheet feeding step of successively feeding sheets supported on sheet supporting means;

the first registration correcting step of correcting the registration of said sheets fed from said sheet supporting means at a first registration correcting position;

the second registration correcting step of correcting the registration of the sheets between said first registration correcting position and an image recording position at a second registration correcting position;

the sheet interval detecting step of detecting the interval between the sheets provided between said first registration correcting position and said second registration correcting position;

the judging step of judging whether the interval between said sheets detected by said sheet interval detecting step is a predetermined interval; and the controlling stop of controlling said sheet feeding step and said first registration correcting step independently of each other in conformity with the result of the judgement at said judging step;

said judging step having at least two judgement references of said predetermined interval.

19. A sheet conveying apparatus characterized by the provision of:

sheet feeding means for feeding sheets from sheet supporting means on which said sheets are supported;

first sheet conveying means, second sheet conveying means and third sheet conveying means successively disposed downstream of said sheet supporting means with respect to the feeding direction of said sheets for conveying said sheets;

sheet interval judging means for detecting the passage of said sheets between said second sheet conveying means and said third sheet conveying means, and judging whether the intervals between said sheets is a predetermined interval; and control means for independently controlling the driving of said first sheet conveying means and said second sheet conveying means on the basis of the judgement of said sheet interval judging means so that said sheets are conveyed with said predetermined interval.

20. A sheet conveying apparatus according to claim 19, characterized in that said control means independently controls the start and stop of the sheet conveyance of a sheet conveyed next by said first sheet conveying means and said second sheet conveying means, on the basis of the time from after said third sheet conveying means starts the conveyance of the preceding sheet until said sheet conveyed next is detected by said sheet interval judging means.

21. A sheet conveying apparatus according to claim 19, characterized in that said control means independently controls the start and stop of the sheet conveyance of a sheet conveyed next by said first sheet conveying means and said second sheet conveying means, on the basis of the time from after said third sheet conveying means finishes the conveyance of the preceding sheet until said sheet conveyed next is detected by said sheet interval judging means.

22. A sheet conveying apparatus according to claim 19, characterized in that said sheet interval judging means judges a delay when it detects that the interval between said sheets is longer than a predetermined interval, and judges early arrival when it detects that the interval between said sheets is shorter than the predetermined interval.

23. A sheet conveying apparatus according to claim 19, characterized in that said control means stops said second sheet conveying means when the interval between the preceding sheet and the next sheet is narrow, thereby making the interval between said next sheet and said preceding sheet into a predetermined interval, and delays the conveyance of the further next sheet by a time corresponding to the time by which said next sheet has been delayed, thereby making the interval between said next sheet and said further next sheet into said predetermined interval.

24. A sheet conveying apparatus according to claim 19, characterized in that said control means stops said second sheet conveying means when the interval between the preceding sheet and the next sheet is narrow, thereby making the interval between said next sheet and said preceding sheet into a predetermined interval, and delays the starting of said sheet feeding means and said second sheet conveying means by a predetermined time when the further next sheet is conveyance-controlled.

25. A sheet conveying apparatus according to claim 19, characterized in that said control means stops said second sheet conveying means for a predetermined time when the interval between the preceding sheet and the next sheet is narrow, and delays the starting of said sheet feeding means and said second sheet conveying means by a predetermined time when it conveyance-controls the next but one sheet.

26. A sheet conveying apparatus according to claim 19, characterized in that said first conveying means and said third conveying means are provided with registration rollers.

27. An image forming apparatus comprising:

first registration means for correcting a leading end of a sheet and feeding the sheet;

sheet feeding means for feeding the sheet fed by the first registration means;

second registration means disposed downstream of said sheet feeding means with respect to the sheet feeding direction for correcting the leading end of the sheet;

sheet interval detecting means disposed between said first registration means and said second registration means for detecting the interval between sheets; and means for drive-controlling said sheet feeding means and said first registration means by a signal from said sheet interval detecting means.

28. An image forming apparatus according to claim 27, characterized in that said sheet feeding means, said first registration means and said second registration means can be drive-controlled independently of one another.

29. An image forming apparatus according to claim 27, wherein said first registration means is a pre-registration roller, said sheet feeding means is an ante-registration roller, said second registration means is a registration roller, and said detecting means is disposed downstream of said sheet feeding means.

30. An image forming apparatus according to claim 29, wherein said pre-registration roller is stopped when said detecting means detects that the sheet is reached, and said pre-registration roller is re-driven after a predetermined time.

31. An image forming apparatus according to claim 30, wherein the predetermined time is counted by a delay timer and a pre-registration timer.

32. An image forming apparatus according to claim 31, wherein said ante-registration roller and said pre-registration roller are stopped when said detecting means detects that the sheet is reached early, and said ante-registration roller and said pre-registration roller are re-driven.

33. An image forming apparatus according to claim 31, wherein the delay timer is set when the detecting means detects that the sheet is delayed, and the re-drive is delayed.

34. An image forming apparatus according to claim 33, wherein said sheet feeding means is provided upstream of said pre-registration roller and the drive of said sheet feeding means is also delayed.

* * * * *

UNITED STATES PATENT AND TRADEMARK OFFICE

CERTIFICATE OF CORRECTION

PATENT NO. : 6,311,039 B1
DATED : October 30, 2001
INVENTOR(S) : Yoshihiro Funamizu et al.

It is certified that error appears in the above-identified patent and that said Letters Patent is hereby corrected as shown below:

Column 5,
Line 33, "reuritable" should read -- rewritable --.
Line 49, "e.g." should read -- e.g., --.

Column 6,
Line 2, "e.g." should read -- e.g., --.

Column 7,
Line 23, "counter-clockwisely" should read -- counter-clockwise --.

Column 18,
Line 8, "means, said" should read -- means and said --.
Line 9, "and said second registration" should be deleted.
Line 10, "means" should be deleted.

Column 19,
Lines 25-26, change the font size to that of the regular text font size.

Column 20,
Line 3, "arrive" should read -- arrival --.
Lines 15-16, change the font size to that of the regular text font size.
Line 39, "stop" should read -- step --.

Signed and Sealed this

Thirtieth Day of July, 2002

*Attest:*

*Attesting Officer*

JAMES E. ROGAN
*Director of the United States Patent and Trademark Office*